US012600594B2

(12) United States Patent
Kubo et al.

(10) Patent No.: US 12,600,594 B2
(45) Date of Patent: Apr. 14, 2026

(54) SHEET PROCESSING APPARATUS AND IMAGE FORMING SYSTEM

(71) Applicant: CANON FINETECH NISCA INC., Saitama (JP)

(72) Inventors: Mamoru Kubo, Yamanashi (JP); Kakeru Aoki, Yamanashi (JP); Yusuke Mitsui, Yamanashi (JP); Yuki Nishi, Yamanashi (JP); Yasumichi Okahisa, Yamanashi (JP); Koji Kanda, Yamanashi (JP)

(73) Assignee: Canon Finetech Nisca Inc., Saitama (JP)

( * ) Notice: Subject to any disclaimer, the term of this patent is extended or adjusted under 35 U.S.C. 154(b) by 258 days.

(21) Appl. No.: 18/354,734

(22) Filed: Jul. 19, 2023

(65) Prior Publication Data

US 2024/0025679 A1 Jan. 25, 2024

(30) Foreign Application Priority Data

Jul. 25, 2022 (JP) ..... 2022-117882
Jul. 25, 2022 (JP) ..... 2022-117883

(51) Int. Cl.
*B65H 37/04* (2006.01)
*B65H 5/06* (2006.01)
*B65H 29/26* (2006.01)

(52) U.S. Cl.
CPC ..... *B65H 37/04* (2013.01); *B65H 5/062* (2013.01); *B65H 29/26* (2013.01); *B65H 2301/4421* (2013.01); *B65H 2301/4474* (2013.01); *B65H 2301/5122* (2013.01); *B65H 2402/53* (2013.01); *B65H 2801/06* (2013.01); *B65H 2801/15* (2013.01); *B65H 2801/27* (2013.01)

(58) Field of Classification Search
CPC .... B65H 2801/27; B65H 37/04; B65H 31/02; B65H 2801/24
See application file for complete search history.

(56) References Cited

U.S. PATENT DOCUMENTS 10,406,772 B2 * 9/2019 Takahashi ..... B42C 1/12

FOREIGN PATENT DOCUMENTS

JP 2015-113199 A 6/2015
JP 2021-035889 A 3/2021

OTHER PUBLICATIONS

U.S. Appl. No. 18/354,036, filed Jul. 18, 2023 (First Named Inventor: Toshiyuki Katsumata).
U.S. Appl. No. 18/354,049, filed Jul. 18, 2023 (First Named Inventor: Mamoru Kubo).

* cited by examiner

*Primary Examiner* — Jeremy R Severson
(74) *Attorney, Agent, or Firm* — Venable LLP

(57) ABSTRACT

A sheet dropping portion abuts on a sheet conveyed in a first conveyance direction by a pair of conveyance rotary members from above to drop the sheet onto a placement portion by pivoting from an upper position to a lower position. The guide portion is arranged above the placement portion and extends toward the placement portion, and guides the sheet toward an abutment portion in a case where the sheet on the placement portion conveyed in a second conveyance direction opposite to the first conveyance direction by a reverse conveyance portion comes into contact with the guide portion. The sheet dropping portion located at the lower position overlaps a part of the guide portion when viewed in a rotational axis direction of the pair of conveyance rotary members.

4 Claims, 25 Drawing Sheets

SHEET PROCESSING APPARATUS AND IMAGE FORMING SYSTEM

BACKGROUND OF THE INVENTION

Field of the Invention

The present invention relates to a sheet processing apparatus that performs predetermined processing such as stapling on sheets, and an image forming system including the sheet processing apparatus.

Description of the Related Art

In a sheet processing apparatus, a sheet conveyed from a conveyance path is placed on a processing tray, and processing such as stapling is performed on the sheet on the processing tray. As such a sheet processing apparatus, a configuration has been proposed in which a guide that guides the sheet downward is pivotably provided above the processing tray (JP2021-35889 A).

The guide has a function of pivoting to abut on the sheet conveyed by a pair of conveying rollers disposed above the processing tray from above and dropping the sheet on the processing tray. In the configuration described in JP 2021-35889 A, the pivot axis of the guide is disposed on the downstream side in the conveyance direction of the sheet by the pair of conveying rollers with respect to the pair of conveying rollers, and when the sheet conveyed by the pair of conveying rollers is dropped downward, the distal end of the guide rotates about the pivot axis from the upper position to the lower position downstream of the pair of conveying rollers. The sheet dropped on the processing tray by the guide is conveyed toward the reference surface (abutment portion) (is reversely conveyed in a direction opposite to the conveyance direction by the conveying roller), and predetermined processing such as stapling is performed on the sheet abutting on the reference surface.

SUMMARY OF THE INVENTION

The present invention provides a configuration capable of reducing occurrence of a jam of a sheet reversely conveyed.

According to a first aspect of the present invention, a sheet processing apparatus includes a pair of conveyance rotary members configured to convey a sheet in a first conveyance direction, a placement portion configured to place the sheet conveyed in the first conveyance direction by the pair of conveyance rotary members, a sheet dropping portion that has a pivot axis downstream of the pair of conveyance rotary members in the first conveyance direction, extends from the pivot axis toward an upstream side in the first conveyance direction, is pivotable about the pivot axis from an upper position to a lower position below the upper position, and abuts on the sheet conveyed by the pair of conveyance rotary members from above to drop the sheet onto the placement portion by pivoting from the upper position to the lower position, a reverse conveyance portion that conveys the sheet on the placement portion conveyed by the pair of conveyance rotary members in a second conveyance direction opposite to the first conveyance direction, an abutment portion against which a downstream end edge in the second conveyance direction of the sheet conveyed in the second conveyance direction by the reverse conveyance portion abuts, a guide portion that is arranged above the placement portion and extends toward the placement portion, and guides the sheet toward the abutment portion in a case where the sheet on the placement portion conveyed in the second conveyance direction by the reverse conveyance portion comes into contact with the guide portion, a processing unit configured to perform predetermined processing on the sheet that is conveyed in the second conveyance direction by the reverse conveyance portion and of which the downstream end edge in the second conveyance direction abuts against the abutment portion, a stacking portion that is disposed downstream of the placement portion in the first conveyance direction, and stacks the sheet on which the predetermined processing is performed by the processing unit, and, a discharge portion configured to discharge the sheet on which the predetermined processing is performed by the processing unit to the stacking portion. The sheet dropping portion located at the lower position overlaps a part of the guide portion when viewed in a rotational axis direction of the pair of conveyance rotary members.

According to a second aspect of the present invention, an image forming system includes an image forming apparatus including an image forming unit that forms an image on a sheet, and a sheet processing apparatus configured to perform binding processing on the sheet on which the image is formed by the image forming unit. The sheet processing apparatus includes a pair of conveyance rotary members configured to convey a sheet in a first conveyance direction, a placement portion configured to place the sheet conveyed in the first conveyance direction by the pair of conveyance rotary members, a sheet dropping portion that has a pivot axis downstream of the pair of conveyance rotary members in the first conveyance direction, extends from the pivot axis toward an upstream side in the first conveyance direction, is pivotable about the pivot axis from an upper position to a lower position below the upper position, and abuts on the sheet conveyed by the pair of conveyance rotary members from above to drop the sheet onto the placement portion by pivoting from the upper position to the lower position, a reverse conveyance portion that conveys the sheet on the placement portion conveyed by the pair of conveyance rotary members in a second conveyance direction opposite to the first conveyance direction, an abutment portion against which a downstream end edge in the second conveyance direction of the sheet conveyed in the second conveyance direction by the reverse conveyance portion abuts, a guide portion that is arranged above the placement portion and extends toward the placement portion, and guides the sheet toward the abutment portion in a case where the sheet on the placement portion conveyed in the second conveyance direction by the reverse conveyance portion comes into contact with the guide portion, a processing unit configured to perform predetermined processing on the sheet that is conveyed in the second conveyance direction by the reverse conveyance portion and of which the downstream end edge in the second conveyance direction abuts against the abutment portion, a stacking portion that is disposed downstream of the placement portion in the first conveyance direction, and stacks the sheet on which the predetermined processing is performed by the processing unit, and, a discharge portion configured to discharge the sheet on which the predetermined processing is performed by the processing unit to the stacking portion. The sheet dropping portion located at the lower position overlaps a part of the guide portion when viewed in a rotational axis direction of the pair of conveyance rotary members.

Further features of the present invention will become apparent from the following description of exemplary embodiments with reference to the attached drawings.

DESCRIPTION OF THE EMBODIMENTS

An embodiment will be described with reference to FIGS. 1 to 25B. First, a schematic configuration of an image forming system according to the present embodiment will be described with reference to FIG. 1.

Image Forming System

Figure 1:
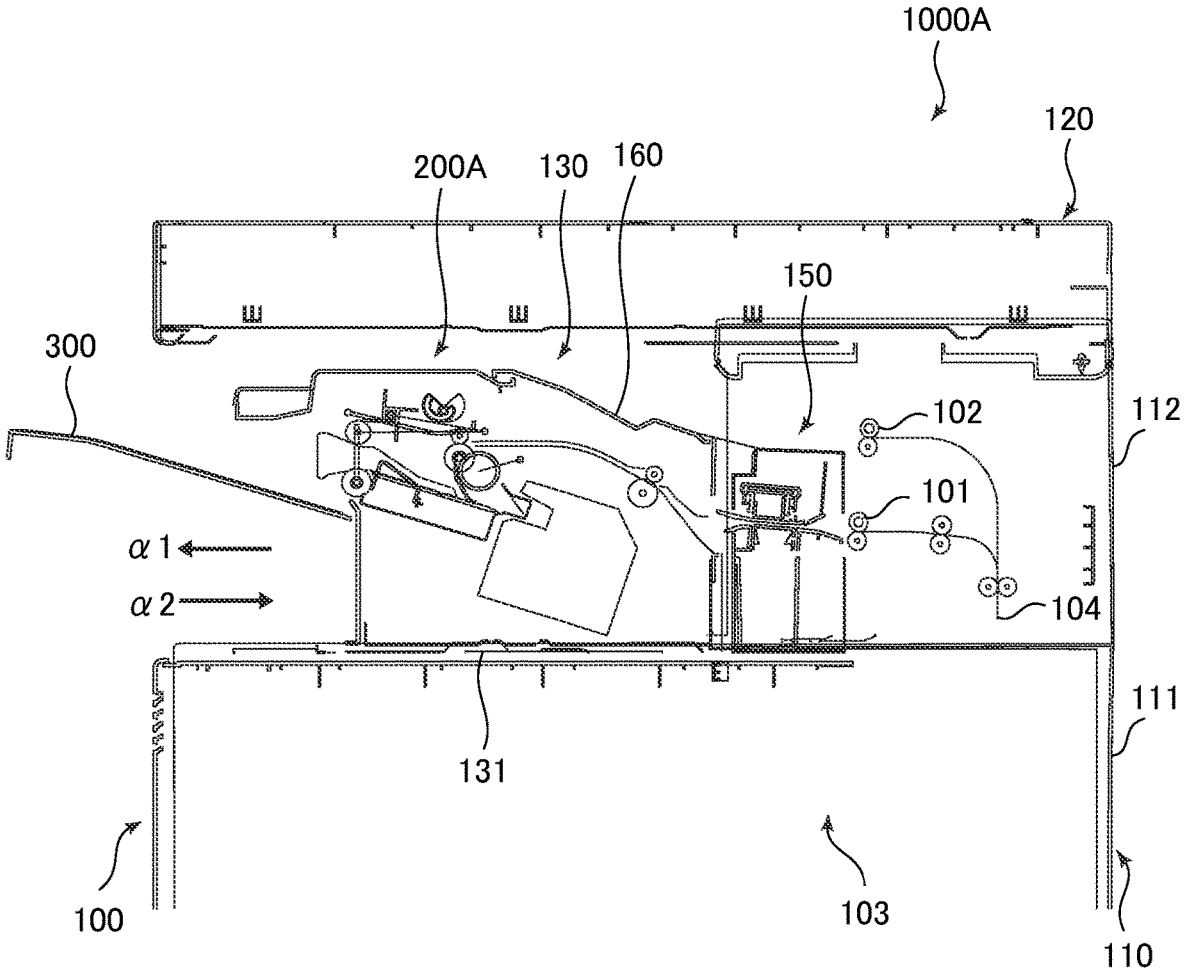
FIG. 1 is a schematic configuration cross-sectional view of an image forming system according to an embodiment.

FIG. 1 is a cross-sectional view illustrating the schematic configuration of the image forming system according to the present embodiment. An image forming system 1000A includes an image forming apparatus 100, a punch unit 150, and a sheet processing apparatus 200A. The image forming apparatus 100 is a copying machine, a printer, a facsimile, a multifunction peripheral having a plurality of functions thereof, or the like, and forms an image on a sheet such as a sheet of paper or a plastic sheet. In the present embodiment, an electrophotographic system printer is used, and a sheet on which a toner image is formed is discharged from a first discharge portion 101 or a second discharge portion 102. The image forming apparatus 100 may be an inkjet type image forming apparatus.

In the image forming apparatus of the present embodiment, although not illustrated in detail, a toner image is formed on a sheet in the image forming unit 103. Briefly, a surface of a photosensitive drum is charged and exposed to form an electrostatic latent image on the photosensitive drum. Then, the electrostatic latent image is developed with a developer by a developing unit to form a toner image. The toner image formed on the photosensitive drum is transferred to a sheet, and further heated and pressed by a fixing unit to be fixed to the sheet. The sheet on which the toner image is fixed is sent to the first discharge portion 101 or the second discharge portion 102 through a conveyance path 104.

The image forming apparatus 100 of the present embodiment includes an image forming apparatus body 110 including the image forming unit 103, the conveyance path 104, the first discharge portion 101, and the second discharge portion 102, and an image reading unit 120 disposed above the image forming apparatus body 110. The image reading unit 120 reads an image on a document and sends a read image signal to the image forming apparatus body 110. The image forming apparatus body 110 includes a first casing unit 111 in which the image forming unit 103 is disposed, and a second casing unit 112 in which a part of the conveyance path 104, the first discharge portion 101, and the second discharge portion 102 are disposed, and the second casing unit 112 is provided above the first casing unit 111. The image reading unit 120 is provided above the second casing unit 112. In addition, an operation panel (not illustrated) is provided in the second casing unit, and an instruction (printing condition, mode setting, and the like) from the user can be input to the image forming apparatus 100, the punch unit 150, and the sheet processing apparatus 200A.

In the present embodiment, with such a configuration, an in-body space 130 surrounded by the first casing unit 111, the second casing unit 112, and the image reading unit 120 is provided. Then, the sheet is discharged from the first discharge portion 101 or the second discharge portion 102 into the in-body space 130. The punch unit 150, the sheet processing apparatus 200A, and the like are detachable from the in-body space 130. In the present embodiment, the image forming system 1000A is configured by attaching the punch unit 150 and the sheet processing apparatus 200A, but any one of the punch unit 150 and the sheet processing apparatus 200A or another apparatus that performs sheet processing may be attached.

The punch unit 150 is connected to the first discharge portion 101, and can receive a sheet discharged from the first discharge portion 101 and perform punch processing on the sheet. The sheet processing apparatus 200A is connected to a sheet discharge portion of the punch unit 150 and receives the sheet discharged from the punch unit 150. As will be described in detail below, predetermined processing such as stapling can be performed on the sheet. It is possible to deliver the sheet to the sheet processing apparatus 200A without performing punch processing by the punch unit 150, and it is also possible to discharge the sheet without performing predetermined processing in the sheet processing apparatus 200A. The sheet discharged from the second discharge portion 102 is discharged to a sheet placement surface 160 above the punch unit 150 and the sheet processing apparatus 200A.

In the in-body space 130, a rail 131 is disposed along a left-right direction in FIG. 1, and the punch unit 150 and the sheet processing apparatus 200A are detachable in directions of arrows $\alpha 1$ and $\alpha 2$ along the rail 131. The punch unit 150 may be omitted, and the sheet processing apparatus 200A may be directly connected to the first discharge portion 101. Further, by making the punch unit 150 and the sheet processing apparatus 200A detachable in this manner, sheet jam processing can be performed.

For example, when the sheet is jammed in the first discharge portion 101, the punch unit 150 and the sheet processing apparatus 200A are pulled out in the direction of the arrow $\alpha 1$ to expose the first discharge portion 101. When the sheet is jammed in the punch unit 150, only the sheet processing apparatus 200A is pulled out in the direction of the arrow $\alpha 1$ to expose the punch unit 150. When the punch unit 150 and the sheet processing apparatus 200A are attached to the image forming apparatus 100, the punch unit 150 and the sheet processing apparatus 200A are pushed in the direction of the arrow $\alpha 2$. As described above, in the present embodiment, since the sheet processing apparatus 200A is disposed in the in-body space 130 of the image forming apparatus 100, it is required to reduce the size of the sheet processing apparatus 200A.

Sheet Processing Apparatus

A configuration of the sheet processing apparatus 200A according to the present embodiment will be described with reference to FIGS. 2 to 11C. First, an overall configuration of the sheet processing apparatus 200A will be described with reference to FIGS. 2 and 3.

Overall Configuration of Sheet Processing Apparatus

The sheet processing apparatus 200A includes a conveyance path 210A, pre-processing rollers 211A and 212A serving as a pair of conveyance rotary members, a processing tray 220 serving as a placement portion, an upper discharge roller (i.e., nip member) 230A and a lower discharge roller 230B serving as a pair of discharge rotary members (i.e., discharge portions), a reversing paddle 240A serving as a reverse conveyance portion, a trailing edge dropping member 250A serving as a sheet dropping portion, an alignment unit 270A serving as a shift unit, a return member 280, a trailing edge regulation member 290 serving as an abutment portion, a stacking tray 300 serving as a stacking portion, a sheet pressing paddle 320A, and the like. The sheet received from the image forming apparatus 100 or the punch unit 150 is conveyed to the conveyance path 210A.

The sheet conveyed from the conveyance path 210A is directly discharged to the stacking tray 300 or placed on the processing tray 220 according to the mode of processing the sheet. The direct discharge to the stacking tray 300 means that sheet is discharged to the stacking tray 220 without being reversely conveyed to a position where staple processing can be executed with the sheet on the processing tray 300. In other words, the sheet processing apparatus 200A has a mode of discharging the sheets on which the staple processing is performed by the staple unit 400 to the stacking tray 300 and a mode of discharging the sheets to the stacking tray 300 without performing the staple processing by the staple unit 400. In the present embodiment, the sheet can be aligned by the alignment unit 270A without being placed on the processing tray 220. Further, the sheet can be also aligned on the processing tray 220, and the staple unit 400 can staple the sheets placed on the processing tray 220. Further, the sheet or a sheet bundle placed on the processing tray 220 can be discharged to the stacking tray 300 by the upper discharge roller 230A and the lower discharge roller 230B serving as the pair of discharge rotary members, and the like. Hereinafter, a configuration of each unit will be described in detail.

Conveyance Path

The conveyance path 210A is a path that conveys a sheet in a first conveyance direction (predetermined direction), and includes an upper guide 2101 that guides an upper surface of the conveyed sheet and a lower guide 2102 that guides a lower surface of the sheet. In the conveyance path 210A, the pre-processing rollers 211A and 212A serving as the pair of conveyance rotary members, and upstream rollers (inlet rollers) 213*a* and 213*b* are disposed. These are disposed in pair so as to be separated from each other in a width direction of the sheet (direction of arrow γ in FIG. 3) intersecting a conveyance direction of the sheet (first conveyance direction, direction of arrow β in FIG. 2 (left-right direction)), respectively.

The pre-processing rollers 211A and 212A are conveyance members and the pair of conveyance rotary members that convey a sheet, and at least one of the pre-processing rollers 211A and 212A rotates while nipping the sheet. At least one of the upstream rollers 213*a* and 213*b* rotates while nipping the sheet. The upstream rollers 213*a* and 213*b* are disposed at an inlet of the sheet processing apparatus 200A, and receive a sheet conveyed from upstream of the sheet processing apparatus 200A and convey the sheet to the conveyance path 210A. Then, the sheet passing through the conveyance path 210A reaches the pre-processing rollers 211A and 212A.

The pre-processing rollers 211A and 212A form a pre-processing nip portion 211*a* capable of nipping and conveying a sheet. Then, the sheet is nipped by the pre-processing nip portion 211*a* and conveyed in the first conveyance direction, and the sheet is discharged from the conveyance path 210A. As will be described below, the pre-processing rollers 211A and 212A can be brought into contact with or separated from each other, or the nip pressure can be changed.

Processing Tray

The processing tray 220 serving as the placement portion is disposed on a downstream side in a sheet conveyance direction (first conveyance direction) of the conveyance path 210A and vertically below the conveyance path 210A. The processing tray 220 is inclined with respect to a horizontal plane such that an upstream side in the first conveyance direction is lower than the downstream side in the first conveyance direction. The processing tray 220 temporarily places the sheet conveyed to the downstream side in the first conveyance direction by the pre-processing rollers 211A and 212A. In addition, the processing tray 220 can stack a plurality of sheets in an overlapping manner, and alignment of the sheets in the width direction and movement of the sheets in the width direction (shift of the sheets) are performed by the alignment unit 270A with the sheets on the process tray 220. The trailing edge regulation member 290 serving as the abutment portion against which an upstream end edge (a downstream end edge in a second conveyance direction opposite to the first conveyance direction, and a trailing edge of the sheet) of the sheet placed on the processing tray 220 in the first conveyance direction abuts is disposed at an upstream end of the processing tray 220 in the first conveyance direction. A part of the processing tray 220 (for example, the downstream side end portion in the first conveyance direction) may protrude vertically above the conveyance path 210A.

Further, the staple unit 400 serving as a processing unit is disposed upstream of the processing tray 220 in the first conveyance direction. The staple unit 400 performs staple processing (binding processing) as predetermined processing on the sheet bundle subjected to the alignment in the width direction and regulation of the trailing edge by the processing tray 220. The staple unit 400 is configured to change a staple position with respect to the sheet bundle and to move according to the staple position. The predetermined processing may be other processing such as punching other than stapling. The sheet or the sheet bundle placed on the processing tray 220 are discharged to the stacking tray 300 by the upper discharge roller 230A and the lower discharge roller 230B as described below.

Reversing Paddle

The reversing paddle 240A serving as the reverse conveyance portion conveys the sheet on the processing tray 220 in the second conveyance direction opposite to the first conveyance direction. The reversing paddle 240A includes a paddle portion 2401 serving as a rotation member, a paddle arm 2402 serving as a supporting portion that supports the paddle portion 2401, and a swing fulcrum 2403 that swingably supports the paddle arm 2402. That is, the paddle arm 2402 is swingable in a vertical direction about the swing fulcrum 2403, and the paddle portion 2401 is rotatably provided at the distal end of the paddle arm 2402.

The reversing paddle 240A is swingable about the swing fulcrum 2403 between a return position where the paddle portion 2401 abuts on the upper surface of the sheet on the processing tray 220 to convey the sheet in the second conveyance direction and an upper retracting position where the paddle portion 2401 is retracted above the return position. The swing fulcrum 2403 is disposed upstream of the pre-processing nip portion 211*a*, which is a nip position at which the sheet is nipped by the pre-processing rollers 212A and 211A, in the first conveyance direction and vertically above the pre-processing nip portion 211*a*. The paddle arm

Figure 3:
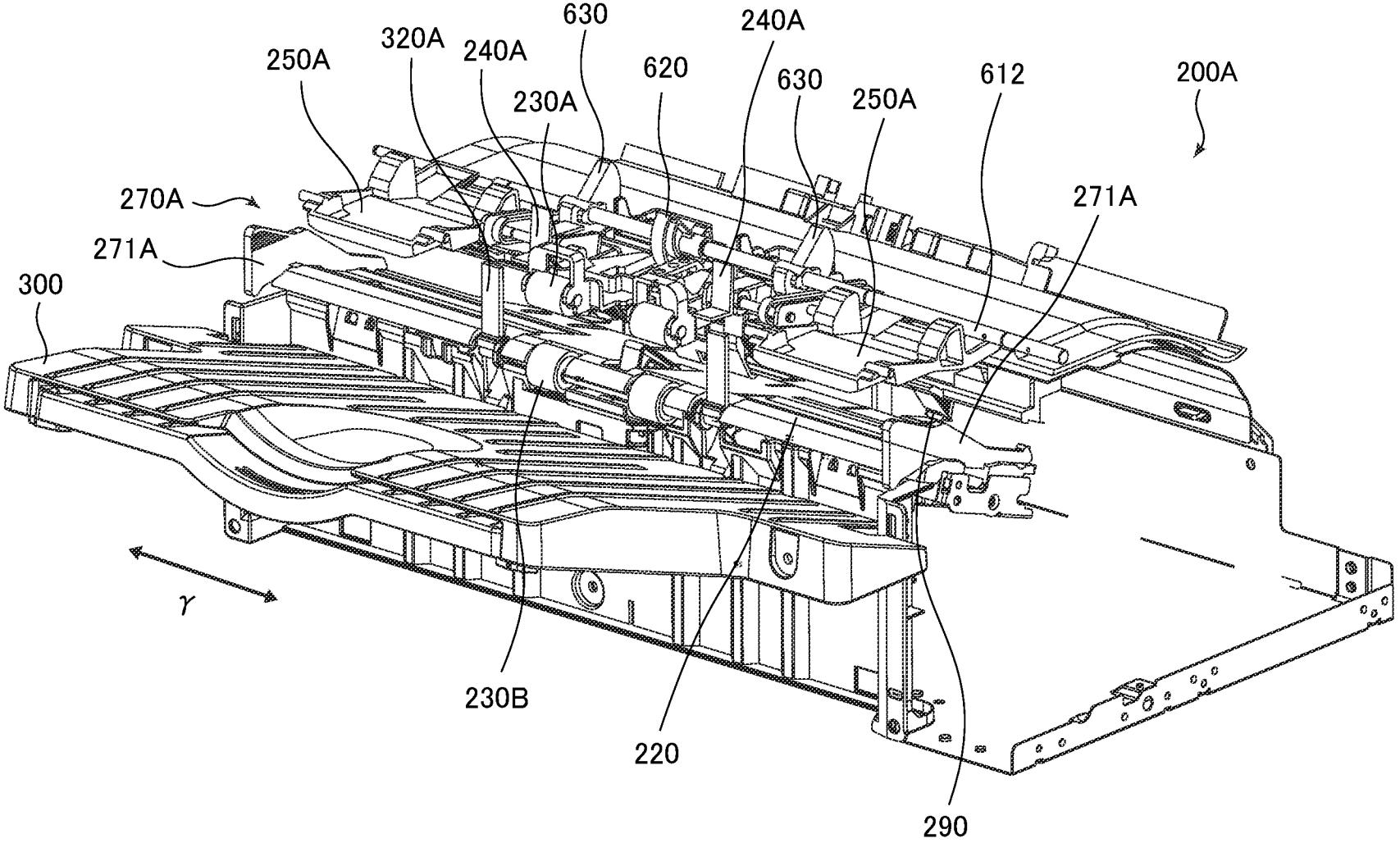
FIG. 3 is a schematic configuration perspective view illustrating the sheet processing apparatus according to the embodiment in a state where an upper cover is removed.

2402 extends from the swing fulcrum 2403 toward the downstream side in the first conveyance direction, and the paddle portion 2401 is provided at a distal end portion thereof. As illustrated in FIG. 3, a pair of the reversing paddles 240A is disposed on both sides in the width direction of the upper discharge roller 230A to be described below.

Trailing Edge Dropping Member

A pair of the trailing edge dropping members 250A serving as the sheet dropping portion is provided on both sides of the pair of reversing paddles 240A. That is, the pair of the trailing edge dropping members 250A is disposed on both sides of the reversing paddle 240A in the width direction, and moves in the vertical direction in conjunction with the reversing paddle 240A as described below, so that the pair of the trailing edge dropping members 250A operates to abut on the upper surface of the sheet on the upstream side in the first conveyance direction and to drop the upstream end portion (trailing edge portion) of the sheet toward the processing tray 220. The trailing edge dropping member 250A may be operated by a separate drive from the reversing paddle 240A.

The trailing edge dropping member 250A includes a pivot shaft 2501 serving as the pivot axis downstream of the pre-processing rollers 211A and 212A serving as the pair of conveyance rollers in the first conveyance direction. The trailing edge dropping member 250A extends to the upstream side in the first conveyance direction from the pivot shaft 2501, and is pivotable about the pivot shaft 2501 from an upper position above the pre-processing nip portion 211*a* of the pre-processing rollers 211A and 212A to a lower position below the pre-processing nip portion 211*a* of the pre-processing rollers 211A and 212A. The trailing edge dropping member 250A pivots from the upper position to the lower position, and thus, abuts on the sheet conveyed by the pre-processing rollers 211A and 212A from above and drops the sheet onto the processing tray 220 below.

Return Member

The return member 280 conveys the sheet conveyed toward the trailing edge regulation member 290 by the reversing paddle 240A as described above, further toward the trailing edge regulation member 290, and brings the trailing edge of the sheet into contact with the trailing edge regulation member 290 to regulate the trailing edge position of the sheet. The return member 280 is configured by a knurled belt 281, and rotationally drives the knurled belt 281 to further convey the sheet conveyed to the upstream side in the first conveyance direction by the reversing paddle 240A, thereby bringing the trailing edge into contact with the trailing edge regulation member 290. The return member 280 is movable to an abutting position where the return member 280 can abut on the sheet and a retracting position where the return member 280 is retracted above the abutting position, and moves to the abutting position when the sheet is conveyed toward the trailing edge regulation member 290 and to the retracting position when the sheet on the processing tray 220 is conveyed toward the stacking tray 300.

Discharge Roller

The upper discharge roller 230A and the lower discharge roller 230B configure the pair of discharge rotary members and the discharge portion, convey the sheet conveyed to the downstream side in the first conveyance direction by the pre-processing rollers 211A and 212A to the downstream side in the first conveyance direction with respect to the processing tray 220, and discharge the sheet. Specifically, the upper discharge roller 230A and the lower discharge roller 230B discharge the sheets stapled by the staple unit 400 onto the stacking tray 300. The upper discharge roller 230A is movable to a nip position (contact position) where the sheet is nipped between the upper discharge roller 230A and the lower discharge roller 230B and a retracting position where the upper discharge roller 230A is retracted above the nip position, and nips the sheet between the upper discharge roller 230A and the lower discharge roller 230B at the nip position. That is, the upper discharge roller 230A functions as a nip member that nips the sheet between the upper discharge roller 230A and the lower discharge roller 230B at the nip position. Two upper discharge rollers 230A are disposed apart from each other in the width direction of the sheet. Two lower discharge rollers 230B are disposed apart from each other in the width direction of the sheet. In the present embodiment, the upper discharge rollers 230A and the lower discharge rollers 230B are disposed inside the pair of reversing paddles 240A in the width direction.

The upper discharge roller 230A and the lower discharge roller 230B nip the sheet or the sheet bundle at the nip position, and for example, the lower discharge roller 230B rotates to convey the nipped sheet or sheet bundle. The upper discharge roller 230A is a driven roller that rotates following the rotation of the lower discharge roller 230B, but may be configured to drive. That is, in the present embodiment, the upper discharge roller 230A is the driven rotary member, and the lower discharge roller 230B is the driving rotary member. Further, the upper discharge roller 230A functions as a nip member capable of nipping the sheet with the lower discharge roller 230B at the nip position, but the nip member may be another rotary member such as a belt instead of the roller, or may be an abutting member that abuts on the sheet without rotating like a lever member. Further, the lower discharge roller 230B may be a rotary member such as a belt in addition to the roller.

The upper discharge roller 230A is pivotable about the pivot shaft 2301 between the nip position and the retracting position. In other words, the upper discharge roller 230A is movable up and down between the nip position and the retracting position. The upper discharge roller 230A is provided at a distal end of the discharge arm 2302 serving as a supporting portion. The pivot shaft 2301 is provided coaxially with the swing fulcrum 2403 described above, and is disposed upstream in the first conveyance direction from the pre-processing nip portion 211*a* that nips the sheet with the pre-processing rollers 211A and 212A, and vertically above the pre-processing nip portion 211*a*. Then, the discharge arm 2302 extends from the pivot shaft 2301 to the downstream side in the first conveyance direction, and the upper discharge roller 230A is provided at a distal end portion thereof. The pivot shaft 2301 may not be disposed coaxially with the swing fulcrum 2403, but in the present embodiment, the pivot shafts of the upper discharge roller 230A and the reversing paddle 240A are coaxial.

The pivot shaft 2301 is disposed on the upstream side in the first conveyance direction with respect to a discharge nip portion where the upper discharge roller 230A nips the sheet with the lower discharge roller 230B at the nip position. Further, the upper discharge roller 230A is positioned vertically above the pre-processing nip portion 211*a* that nips the sheet with the pre-processing rollers 211A and 212A in the retracting position, and the pivot shaft 2301 is positioned vertically above the center of the upper discharge roller 230A in the retracting position.

Since the positional relationship between the pivot shaft 2301 and the pre-processing nip portion 211*a* is defined as described above, the upper discharge roller 230A allows the sheet passing through the pre-processing nip portion 211*a* to move toward the stacking tray 300 in the state of being in the retracting position. On the other hand, the upper discharge roller 230A rotates counterclockwise in FIG. 2 about the pivot shaft 2301, thereby moving downward from the retracting position toward the nip position. When the upper discharge roller 230A moves to the nip position, the sheet can be nipped between the upper discharge roller 230A and the lower discharge roller 230B.

Alignment Unit

The alignment unit 270A serving as a shift unit will be described with reference to FIGS. 4A to 4C in addition to FIGS. 2 and 3. The alignment unit 270A moves in a shift direction (width direction) intersecting the first conveyance direction in a state of being in contact with an end edge along the first conveyance direction of the sheet conveyed to the downstream side in the first conveyance direction by the pre-processing rollers 211A and 212A, thereby moving the sheet in the shift direction. Such an alignment unit 270A includes a pair of aligning plates 271A disposed to face each other in the shift direction.

The pair of aligning plates 271A is disposed further downstream of the downstream end portion in the first conveyance direction of the conveyance path 210A, and moves in the width direction to abut on the end edge in the width direction of the sheet, thereby performing the alignment of the sheet in the width direction. In the present embodiment, the aligning plates 271A are disposed on both sides in the width direction of the sheet placed on the processing tray 220, and are movable in the width direction, respectively. The pair of aligning plates 271A extends from the upstream side to the downstream side in the first conveyance direction with respect to the upper discharge roller 230A and the lower discharge roller 230B. The configuration of the pair of aligning plates 271A is the same. The pair of aligning plates 271A moves in the shift direction by the driving of a front side (F side) aligning plate moving motor and a rear side (R side) aligning plate moving motor serving as driving units.

The aligning plate 271A is formed to have a large width in the vertical direction on the downstream side in the first conveyance direction. That is, the aligning plate 271A includes a first plate portion 2701 on the downstream side in the first conveyance direction and a second plate portion 2702 formed to be continuous with the first plate portion 2701 on the upstream side in the first conveyance direction. The first plate portion 2701 has a larger area in the vertical direction than the second plate portion 2702 so as to be able to abut on the conveyed sheet even if the leading edge side of the sheet is curled upward or downward. On the other hand, the second plate portion 2702 is formed to have a height in the vertical direction lower than that of the first plate portion 2701 so as not to interfere with the trailing edge dropping member 250A even when the trailing edge dropping member 250A is located at the lower position. The upper end edge of the second plate portion 2702 is inclined so as to be lower toward the upstream side in the first conveyance direction.

Further, the first plate portion 2701 is formed so as to extend from the upstream side to the downstream side in the first conveyance direction with respect to the upper discharge roller 230A and the lower discharge roller 230B. Accordingly, even when a sheet is discharged by a first shift discharge process described below, at least the first plate portion 2701 can abut on the sheet. Also, the second plate portion 2702 is located on the processing tray 220 and is formed continuously with the first plate portion 2701 in the first conveyance direction. As a result, at least the second plate portion 2702 can abut on the sheet placed on the processing tray 220 by a second shift discharge process described below.

Figure 4A:
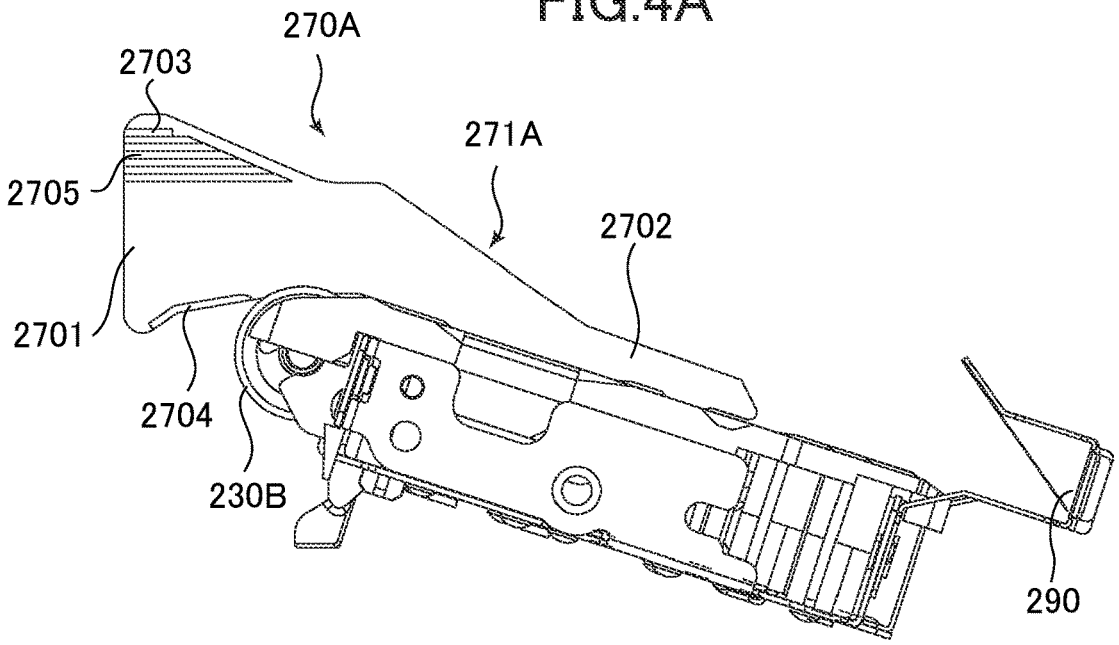
FIG. 4A is a diagram of an aligning plate on a processing tray of the embodiment as viewed from a width direction.
Figure 4B:
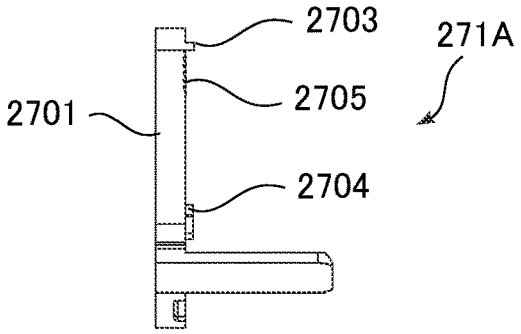
FIG. 4B is a diagram of the aligning plate of the embodiment as viewed from a downstream side in a sheet conveyance direction.
Figure 4C:
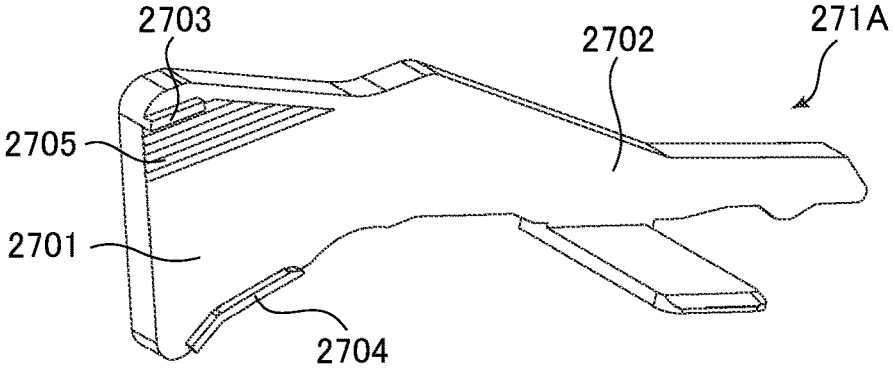
FIG. 4C is a perspective view of the aligning plate of the embodiment.

As illustrated in FIGS. 4A to 4C, the first plate portion 2701 includes a curl pressing portion 2703 and a supporting portion 2704. The curl pressing portion 2703 is provided downstream of the discharge nip portion 230*a* (see FIG. 8B to be described below) in the first conveyance direction, which is a nip position at which the sheet is nipped between the upper discharge roller 230A and the lower discharge roller 230B, and vertically above the discharge nip portion 230*a* to press the leading edge of the sheet curled upward. In the present embodiment, the curl pressing portion 2703 is a protrusion protruding inward in the width direction (side in contact with the sheet, right side in FIG. 4B) from the upper end portion of the first plate portion 2701, and the end edge in the width direction of the curled sheet abuts on the curl pressing portion so that the leading edge of the sheet is pressed. In addition, an uneven portion 2705 is provided below the curl pressing portion 2703, and depending on a curled state, the end edge of the sheet in the width direction is caught by the uneven portion 2705, so that the leading edge of the curled sheet can be pressed.

The supporting portion 2704 is provided downstream of the discharge nip portion 230*a* in the first conveyance direction, which is the nip position at which the sheet is nipped between the upper discharge roller 230A and the lower discharge roller 230B, and vertically below the discharge nip portion 230*a* to support the sheet from below. In the present embodiment, the supporting portion 2704 is a protruding portion protruding inward in the width direction (side in contact with the sheet, right side in FIG. 4B) from the lower end portion of the first plate portion 2701. As illustrated in FIGS. 4A and 4C, an inclined portion 2704*a* inclined downward toward the downstream side is formed at the downstream end portion of the supporting portion 2704 in the first conveyance direction. Accordingly, the sheet supported by the supporting portion 2704 can be smoothly guided to the stacking tray 300. In addition, since the sheet on the downstream side of the discharge nip portion 230*a* in the first conveyance direction is supported by the supporting portion 2704, it is possible to increase an area where the pair of aligning plates 271A abut on the sheet side edge as compared with a case where the sheet is not supported.

Stacking Tray

As described above, the sheet discharged by the upper discharge roller 230A and the lower discharge roller 230B is stacked on the stacking tray 300 serving as the stacking portion. The stacking tray 300 is provided downstream of the processing tray 220 in the first conveyance direction so as to be vertically movable downward. The stacking tray 300 is inclined with respect to the horizontal plane such that the upstream side in the first conveyance direction is lower than the downstream side thereof. Such a stacking tray 300 is supported so as to be movable in the vertical direction along rails disposed in the vertical direction, for example, and moves up and down by the driving of a stacking tray elevating motor serving as an elevating unit.

An upstream end of the stacking tray 300 in the first conveyance direction is provided with a rising surface 310*a* serving as a supporting side regulating unit that regulates an upstream end (trailing edge) in a predetermined direction of the sheet or the sheet bundle stacked on the stacking tray 300, and a trailing edge presser 310*b* that presses the trailing edge of the sheet abutting on the rising surface 310*a*. The trailing edge presser 310*b* is inclined toward the downstream side in the first conveyance direction toward the upper side, and can press the trailing edge of the sheet even if the trailing edge of the sheet is curled upward. Further, a sheet pressing paddle 320A is provided coaxially with the rotation shaft of the lower discharge roller 230B.

The stacking tray 300 is movable up and down between a first stacking position and a second stacking position below the first stacking position by a stacking tray elevating motor. The second stacking position is a position at which the operation of the stacking tray 300 that has been lowered when the sheets are discharged to the stacking tray 300 is switched to the rising. At the time of sheet discharge, the sheet pressing paddle 320A rotates as the stacking tray 300 moves up and down, and the sheet or the sheet bundle on the stacking tray 300 is pressed by the sheet pressing paddle 320A.

Drive Configuration of Each Unit

Figure 5A:
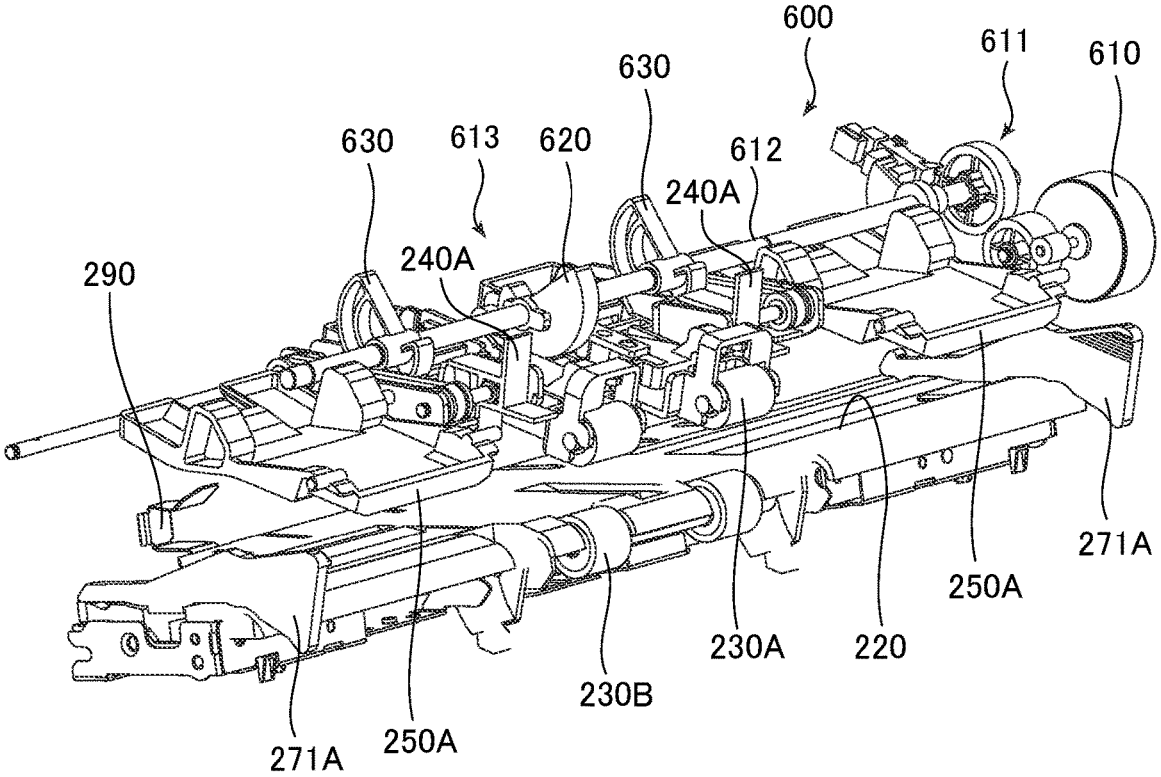
FIG. 5A is a perspective view of a periphery of the processing tray at a home position of the sheet processing apparatus according to the embodiment.
Figure 5B:
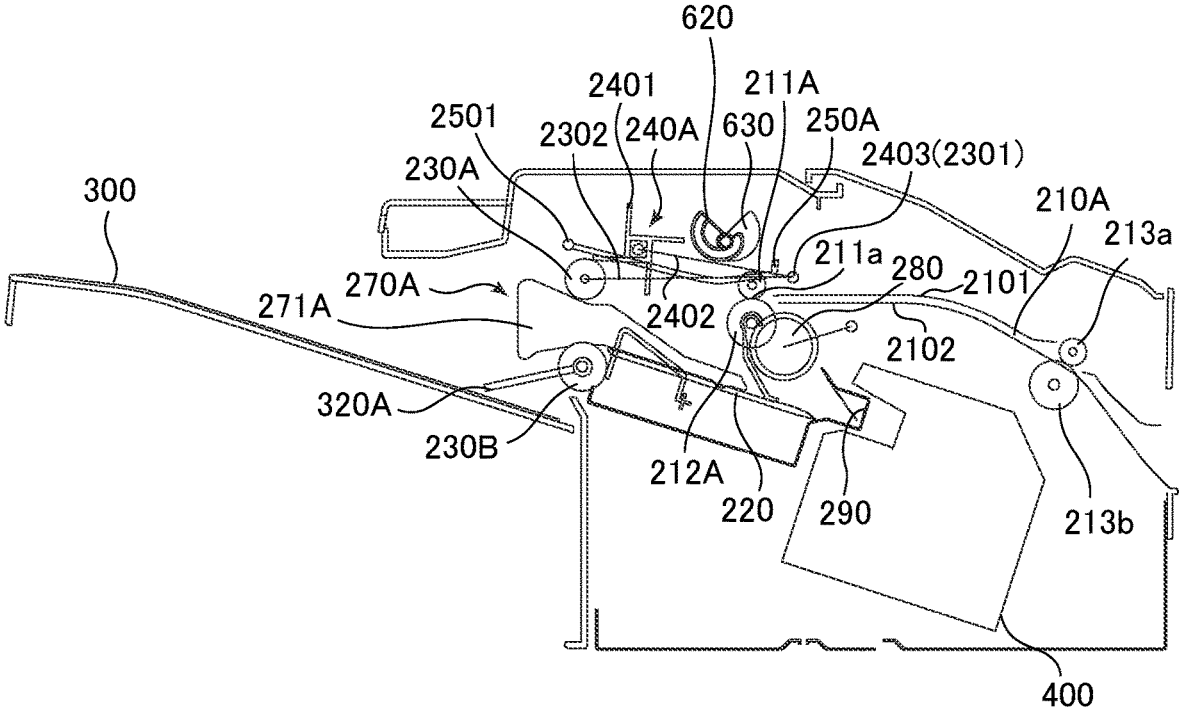
FIG. 5B is a schematic configuration cross-sectional view of the sheet processing apparatus at the home position of the sheet processing apparatus according to the embodiment.

Next, a drive configuration of the upper discharge roller 230A, the reversing paddle 240A, and the trailing edge dropping member 250A will be described with reference to FIGS. 5A to 11C. In the present embodiment, the upper discharge roller 230A, the reversing paddle 240A, and the trailing edge dropping member 250A are configured to interlock with each other. As illustrated in FIG. 5A, these drive configurations 600 include a processing motor 610 serving as a drive source, a drive transmission mechanism 611, a rotation shaft 612, and a cam mechanism 613. The processing motor 610 is rotatable forward and backward, and the drive of the process motor 610 is transmitted to the rotation shaft 612 via the drive transmission mechanism 611. In the present embodiment, the drive transmission mechanism 611 is configured by the gear train, but may have another drive transmission configuration such as a configuration in which drive is transmitted by a belt.

The rotation shaft 612 is disposed above the upper discharge roller 230A, the reversing paddle 240A, and the trailing edge dropping member 250A and overlaps the upper discharge roller 230A, the reversing paddle 240A and the trailing edge dropping member 250A in the width direction. The cam mechanism 613 is operated by the rotation of the rotation shaft 612. The cam mechanism 613 includes a first cam member 620 and a second cam member 630 that rotate together with the rotation shaft 612. The first cam member 620 is disposed between the pair of upper discharge rollers 230A, and operates the upper discharge rollers 230A. One second cam member 630 is provided adjacent to each of the pair of the reversing paddles 240A, and operates the reversing paddle 240A and the trailing edge dropping member 250A.

Figure 6A:
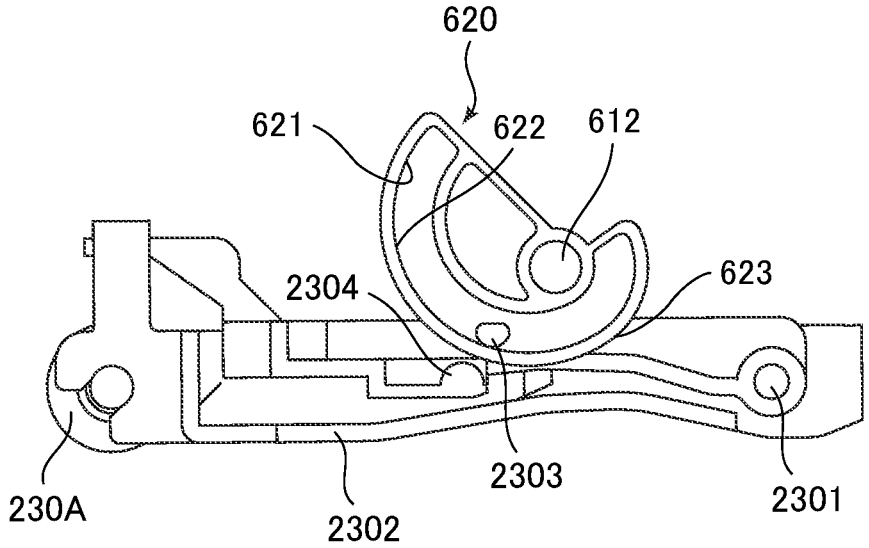
FIG. 6A is a diagram of a state of a discharge roller at the home position of the sheet processing apparatus according to the embodiment as viewed from the width direction.

As illustrated in FIG. 6A, the first cam member 620 is provided therein with a groove portion 621 into which a protrusion portion 2303 provided on the discharge arm 2302 of the upper discharge roller 230A can enter. The groove portion 621 has an outer peripheral surface, that is, an inner peripheral surface of the first cam member 620 as an inner cam surface 622. The inner cam surface 622 is a cam surface having a different distance from the rotation center of the rotation shaft 612 depending on the phase in the rotation direction. The outer peripheral surface of the first cam member 620 is an outer cam surface 623. The outer cam surface 623 is also a cam surface having a different distance from the rotation center of the rotation shaft 612 depending on the phase in the rotation direction.

The discharge arm 2302 of the upper discharge roller 230A includes, in addition to the protrusion portion 2303 described above, a contact portion 2304 that can abut on the outer cam surface 623 of the first cam member 620. The first cam member 620 rotates together with the rotation shaft 612 to change the abutting position (phase) between the inner cam surface 622 and the protrusion portion 2303, or to separate them to change the abutting position (phase) between the outer cam surface 623 and the contact portion 2304, or to separate them to rotate the upper discharge roller 230A about the pivot shaft 2301 from the nip position to the retracting position as described below.

Figure 6B:
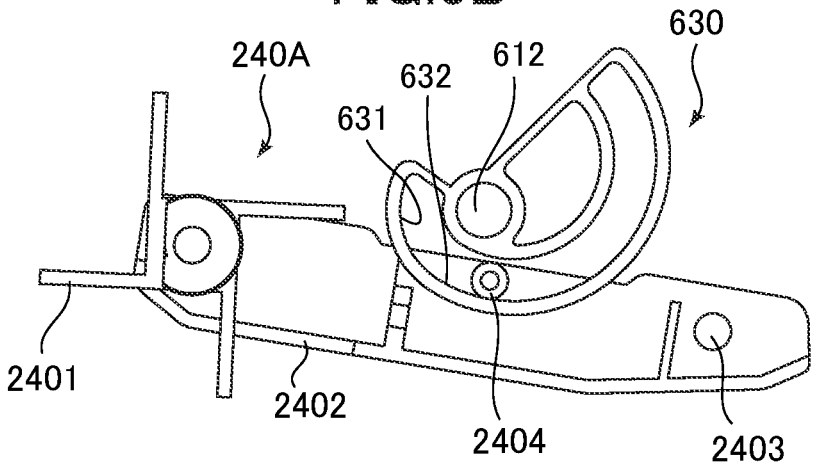
FIG. 6B is a diagram of a state of a reversing paddle at the home position of the sheet processing apparatus according to the embodiment as viewed from the width direction.

As illustrated in FIG. 6B, the second cam member 630 is provided therein with the groove portion 631 into which a first protrusion portion 2404 provided on the paddle arm 2402 of the reversing paddle 240A can enter. The groove portion 631 has an outer peripheral surface, that is, an inner peripheral surface of the second cam member 630 as an inner cam surface 632. The inner cam surface 632 is a cam surface having a different distance from the rotation center of the rotation shaft 612 depending on the phase in the rotation direction. The second cam member 630 rotates together with the rotation shaft 612 to change the abutting position (phase) between the inner cam surface 632 and the first protrusion portion 2404, thereby pivoting the reversing paddle 240A from the return position to the upper retracting position about the swing fulcrum 2403 as described below.

Figure 6C:
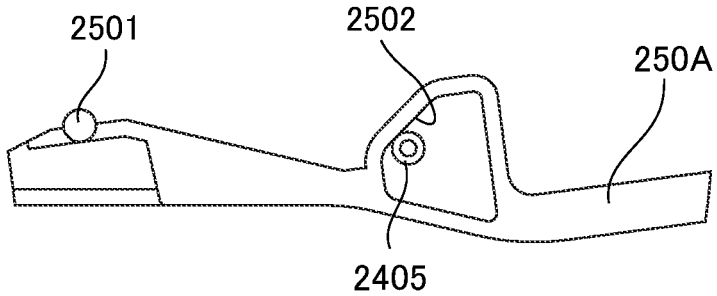
FIG. 6C is a diagram of a state of a trailing edge dropping member at the home position of the sheet processing apparatus according to the embodiment as viewed from the width direction.
Figure 7:
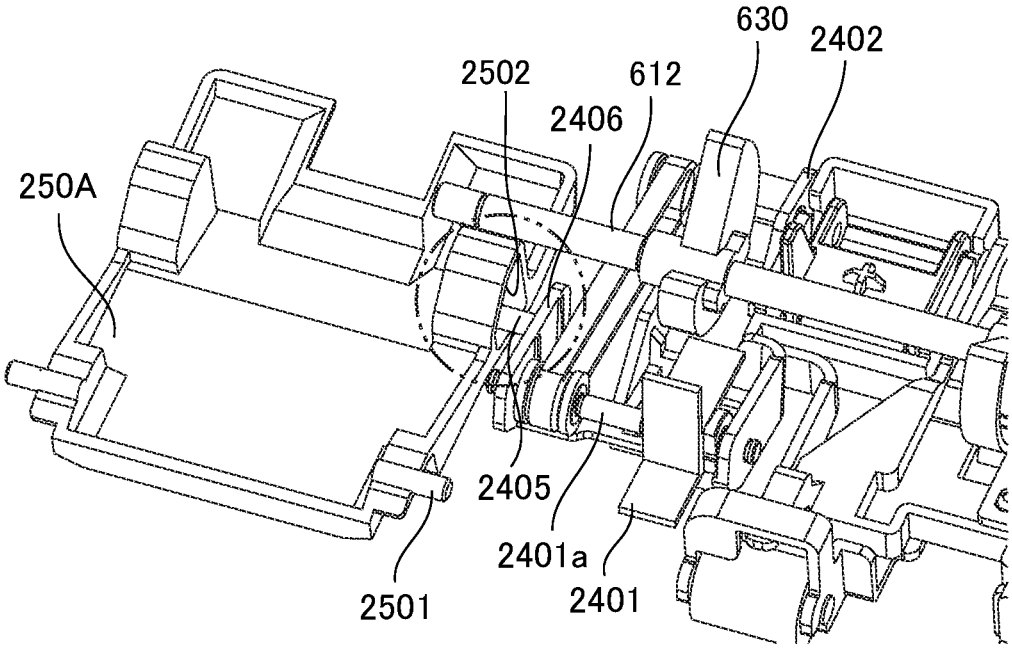
FIG. 7 is a perspective view illustrating an engagement relationship between the trailing edge dropping member and the reversing paddle of the embodiment.

In addition, as illustrated in FIGS. 6C and 7, the supporting portion 2406 that swings about the swing fulcrum 2403 together with the paddle arm 2402 of the reversing paddle 240A and supports the end portion of the rotation shaft 2401*a* of the paddle portion 2401 is provided with a second protrusion portion 2405 that can enter the engagement recess portion 2502 formed in the trailing edge dropping member 250A. The engagement recess portion 2502 abuts on or separates from the second protrusion portion 2405, thereby rotating the trailing edge dropping member 250A from the upper position to the lower position about the pivot shaft 2501 in conjunction with the rotation of the reversing paddle 240A. Hereinafter, the driving of the upper discharge roller 230A, the reversing paddle 240A, and the trailing edge dropping member 250A will be specifically described.

Home Position

First, FIGS. 5A to 6C illustrate the locations of the home position (HP) of the upper discharge roller 230A, the reversing paddle 240A, and the trailing edge dropping member 250A. In the home position, as illustrated in FIGS. 5A and 5B, the upper discharge roller 230A is located at the retracting position, the reversing paddle 240A is located at the upper retracting position, and the trailing edge dropping member 250A is located at the upper position.

In this state, as illustrated in FIG. 6A, the protrusion portion 2303 of the upper discharge roller 230A abuts on the inner cam surface 622 of the first cam member 620 at a position close to the center of the rotation shaft 612, so that the upper discharge roller 230A is supported by the first cam member 620.

As illustrated in FIG. 6B, the first protrusion portion 2404 of the reversing paddle 240A abuts on the inner cam surface 632 of the second cam member 630 at a position close to the center of the rotation shaft 612, so that the scarping paddle 240A is supported by the second cam member 630.

Further, as illustrated in FIG. 6C, the engagement recess portion 2502 of the trailing edge dropping member 250A abuts on the second protrusion portion 2405 of the reversing paddle 240A, so that the trailing edge dropping member 250A is supported by the reversing paddle 240A via the second protrusion portion 2405.

Lowering of Upper Discharge Roller

Next, an operation of moving the upper discharge roller 230A from the home position (retracting position) to the nip position will be described with reference to FIGS. 8A to 9C.

When the processing motor 610 is driven to rotate the rotation shaft 612 in a first direction (counterclockwise direction in FIGS. 9A and 9B) in order to lower the upper discharge roller 230A from the home position, the first cam member 620 also rotates in the same direction, and the protrusion portion 2303 moves along the inner cam surface 622. The inner cam surface 622 is formed such that the distance from the center of the rotation shaft 612 increases when the inner cam surface rotates counterclockwise from the home position. Therefore, the upper discharge roller 230A is lowered by this operation.

Figure 9A:
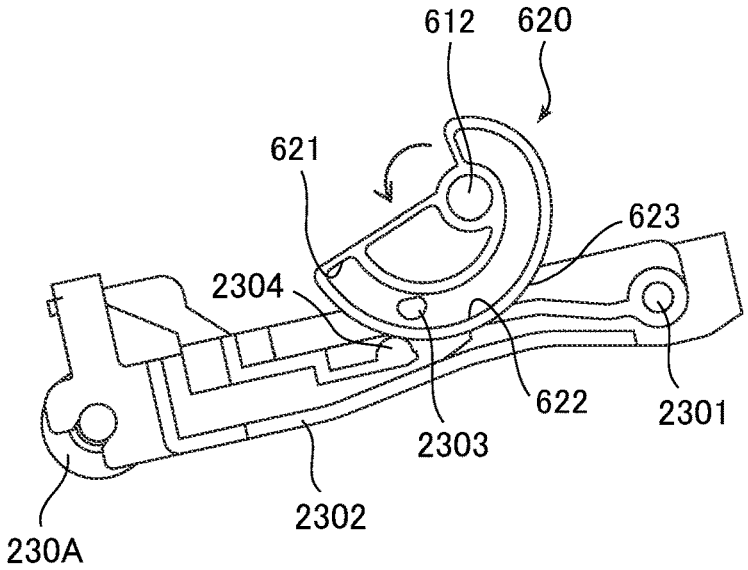
FIG. 9A is a diagram of a state of the discharge roller at the time of sheet discharge of the sheet processing apparatus according to the embodiment as viewed from the width direction.

Next, when the upper discharge roller 230A moves to the nip position and comes into contact with the lower discharge roller 230B, as illustrated in FIG. 9A, the inner cam surface 622 of the first cam member 620 and the protrusion portion 2303 are separated from each other, and the outer cam surface 623 comes into contact with the contact portion 2304. By bringing the outer cam surface 623 into contact with the contact portion 2304 in this manner, the upper discharge roller 230A is pressurized against the lower discharge roller 230B, and a predetermined nip pressure is applied between these rollers.

Figure 8A:
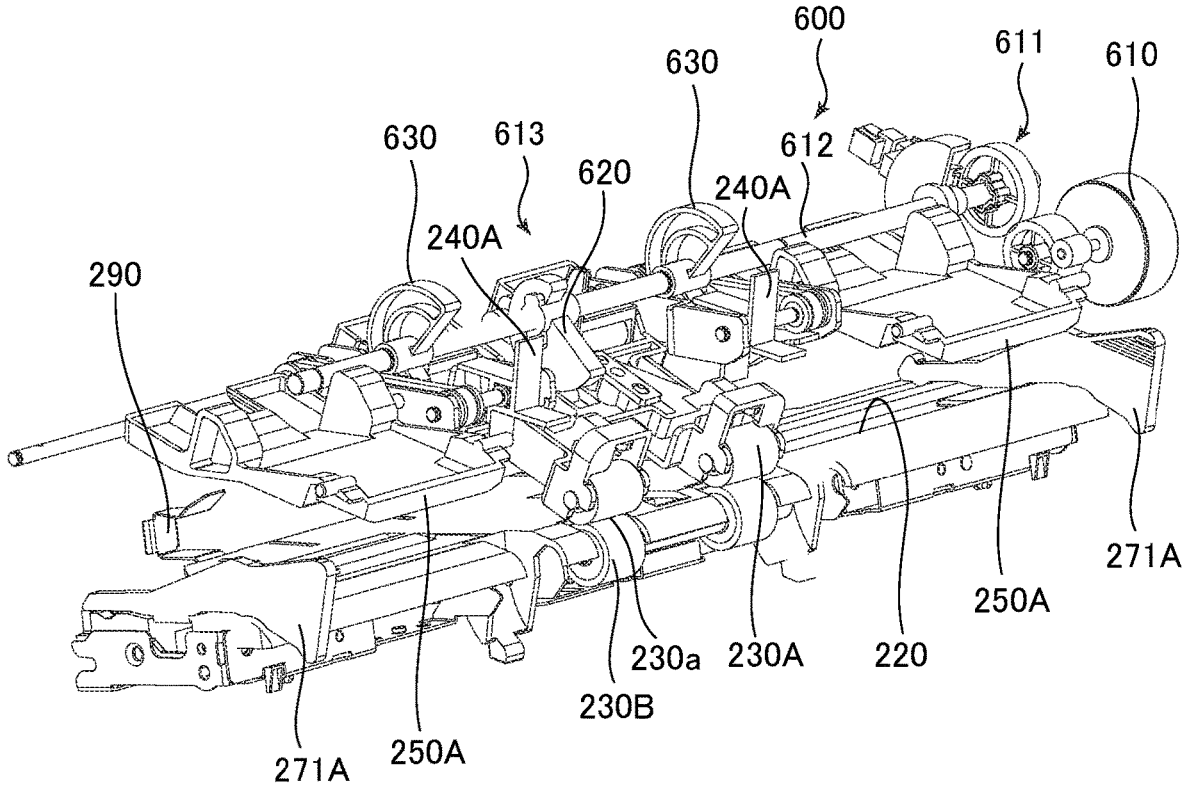
FIG. 8A is a perspective view of the periphery of the processing tray at the time of sheet discharge of the sheet processing apparatus according to the embodiment.
Figure 8B:
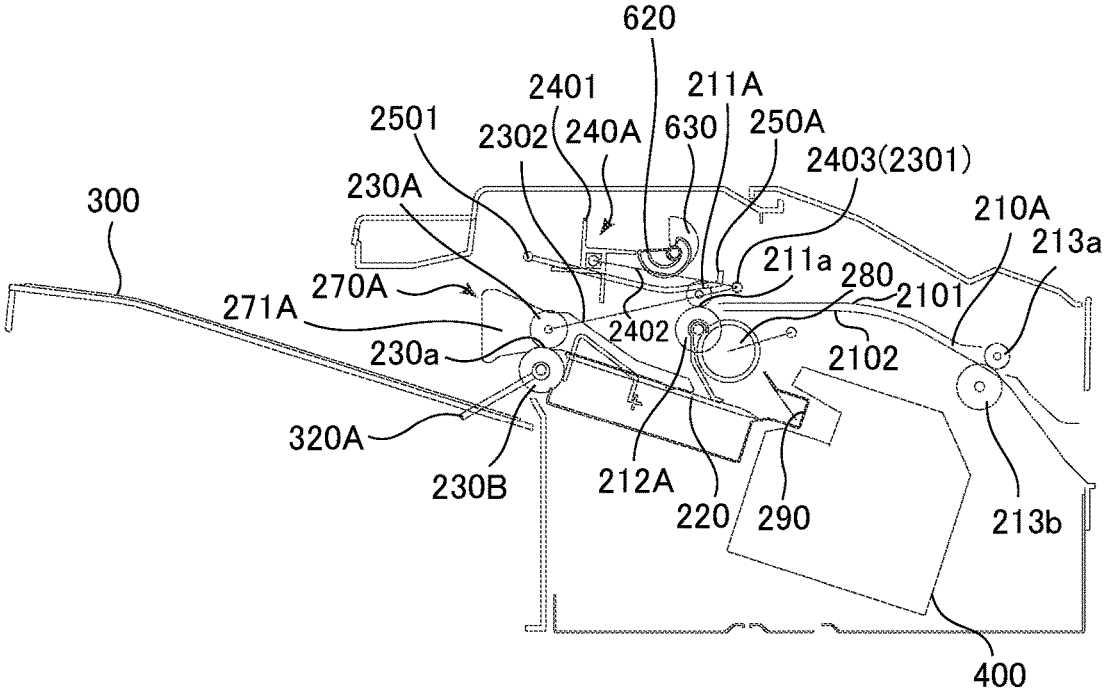
FIG. 8B is a schematic configuration cross-sectional view of the sheet processing apparatus at the time of sheet discharge of the sheet processing apparatus according to the embodiment.
Figure 9B:
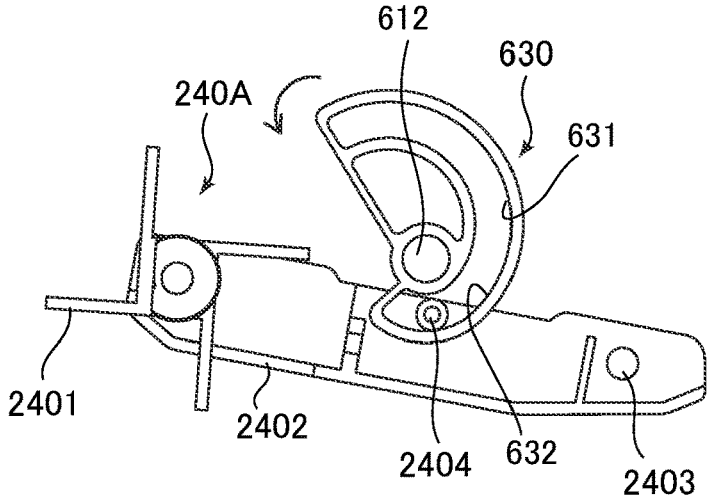
FIG. 9B is a diagram of a state of the reversing paddle at the time of sheet discharge of the sheet processing apparatus according to the embodiment as viewed from the width direction.
Figure 9C:
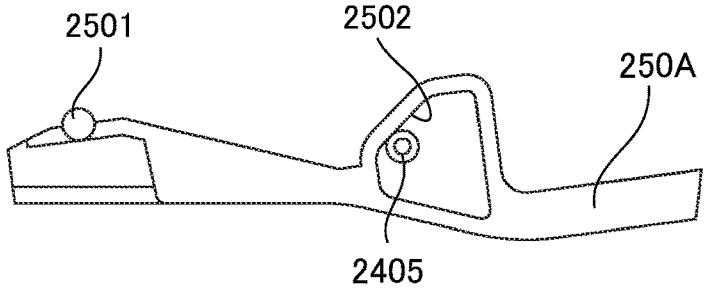
FIG. 9C is a diagram of a state of the trailing edge dropping member at the time of sheet discharge of the sheet processing apparatus according to the embodiment as viewed from the width direction.

At this time, the second cam member 630 also rotates together with the rotation shaft 612, and as illustrated in FIG. 9B, the distance from the center of the rotation shaft 612 to the position where the inner cam surface 632 abuts on the first protrusion portion 2404 is substantially the same as the distance at the home position. Therefore, even when the second cam member 630 rotates, the reversing paddle 240A is maintained at the home position. Since the reversing paddle 240A is maintained at the home position, the trailing edge dropping member 250A is also maintained at the home position as illustrated in FIG. 9C. That is, in this state, as illustrated in FIG. 8B, the upper discharge roller 230A moves to the nip position, but the reversing paddle 240A and the trailing edge dropping member 250A are maintained at the home positions.

When the upper discharge roller 230A is lifted, the processing motor 610 is driven to rotate the rotation shaft 612 in the second direction (clockwise direction in FIGS. 9A and 9B) opposite to the first direction. Then, the first cam member 620 rotates in the same direction together with the rotation shaft 612, the protrusion portion 2303 moves along the inner cam surface 622, and the upper discharge roller 230A rises. Then, the upper discharge roller returns to the home position illustrated in FIG. 6A.

Here, when the reversing paddle 240A and trailing edge dropping member 250A return from the state of FIGS. 9B and 9C to the state of FIGS. 6B and 6C, the first protrusion portion 2404 moves along the inner cam surface 632 of the second cam member 630, and at this time, the inner cam surface 632 is formed such that the distance from the center of the rotation shaft 612 to the position where the inner cam surface 632 abuts on the first protrusion portion 2404 does not change. Therefore, the reversing paddle 240A still remains at the home position. Since the reversing paddle 240A is maintained at the home position, the trailing edge dropping member 250A is also maintained at the home position.

Lowering of Reversing Paddle and Trailing Edge Dropping Member

Figure 10A:
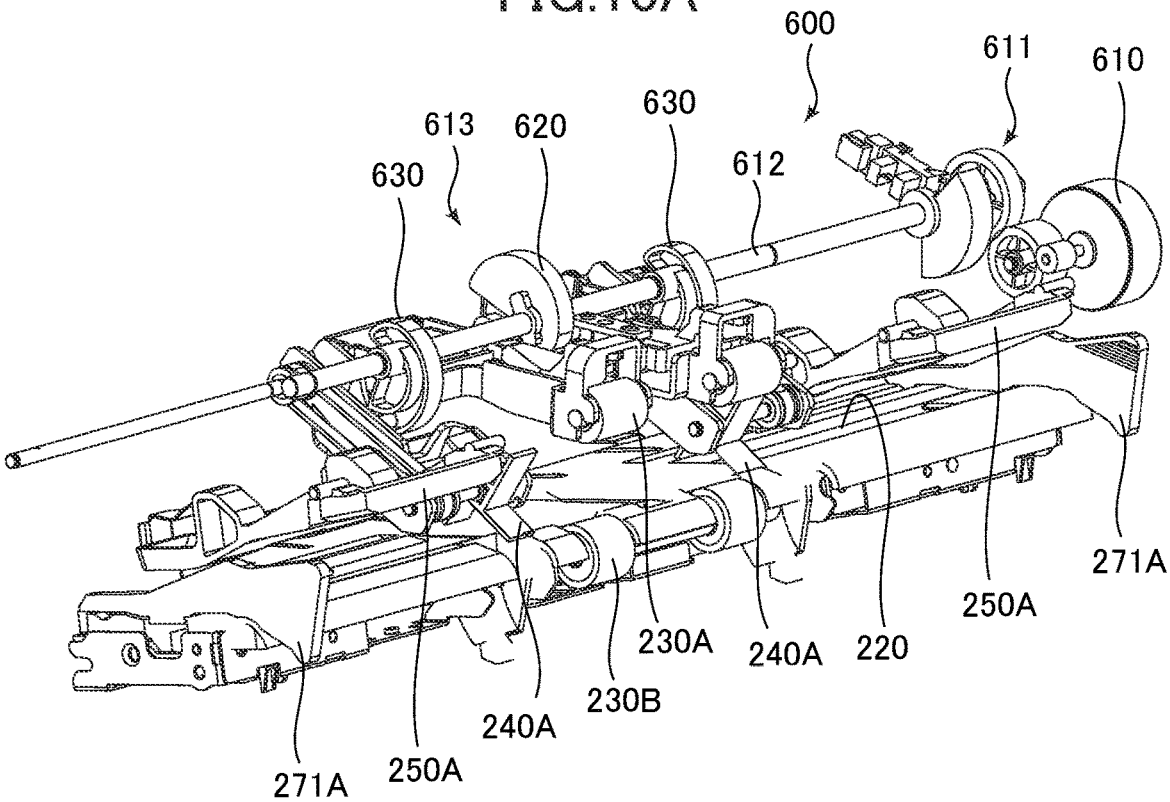
FIG. 10A is a perspective view of a periphery of the processing tray at the time of sheet reverse conveying of the sheet processing apparatus according to the embodiment.
Figure 10B:
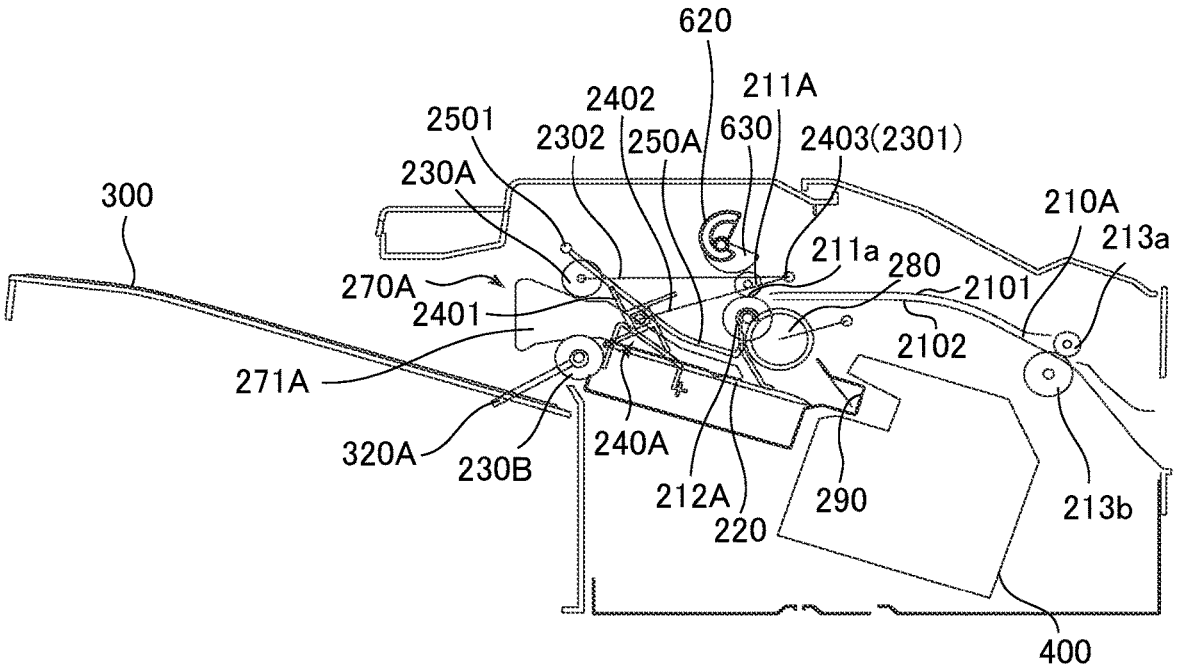
FIG. 10B is a schematic configuration cross-sectional view of the sheet processing apparatus at the time of sheet reverse conveying of the sheet processing apparatus according to the embodiment.
Figure 11A:
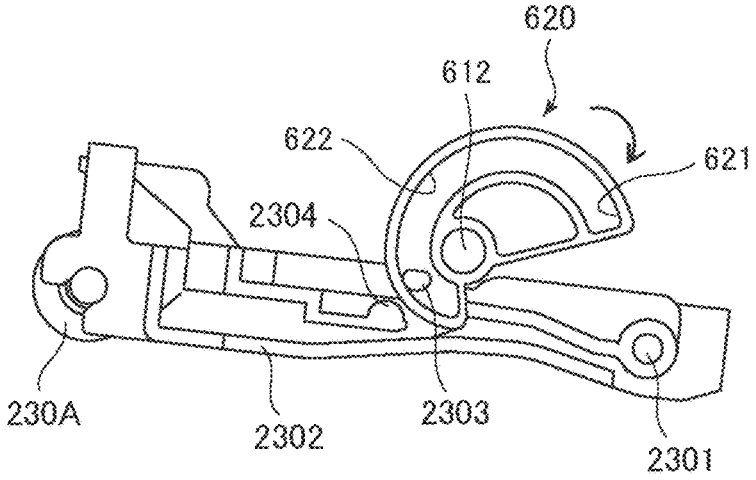
FIG. 11A is a diagram of a state of the discharge roller at the time of sheet reverse conveying of the sheet processing apparatus according to the embodiment as viewed from the width direction.

Next, an operation of moving the reversing paddle 240A and the trailing edge dropping member 250A from the home positions (upper retracting position, upper position) to the return position and the lower position will be described with reference to FIGS. 10A to 11C. When the processing motor 610 is driven to rotate the rotation shaft 612 in the second direction (clockwise direction in FIGS. 11A and 11B) opposite to the first direction in order to lower the reversing paddle 240A and the trailing edge dropping member 250A from the home positions, the first cam member 620 also rotates in the same direction, and the protrusion portion 2303 moves along the inner cam surface 622. The inner cam surface 622 is formed such that the distance from the center of the rotation shaft 612 does not change even when the inner cam surface rotates clockwise from the home position. Therefore, as illustrated in FIG. 11A, the upper discharge roller 230A is maintained at the home position.

On the other hand, the second cam member 630 also rotates in the same direction together with the rotation shaft 612, and the first protrusion portion 2404 moves along the inner cam surface 632. The inner cam surface 632 is formed such that the distance from the center of the rotation shaft 612 increases when the inner cam surface rotates clockwise from the home position. Therefore, by this operation, the reversing paddle 240A descends and moves to the return position.

At this time, the trailing edge dropping member 250A also descends together with the reversing paddle 240A. In the present embodiment, the trailing edge dropping member 250A includes the positioning portion 2503 positioning the trailing edge dropping member 250A at the lower position by engaging with the upper guide 2101 of the conveyance path 210A when pivoting from the upper position to the lower position. The positioning portion 2503 is provided at the upper end portion of the protruding portion 2504 provided so as to protrude upward at the distal end (upstream end in the first conveyance direction) of the trailing edge dropping member 250A. The protruding portion 2504 also serves to regulate the leading edge of the sheet conveyed toward the pre-processing nip portion 211*a* on the upstream side in the first conveyance direction with respect to the pre-processing nip portion 211*a* in a state where the trailing edge dropping member 250A is at the lower position.

The positioning portion 2503 is an engagement portion provided at the upper end of the protruding portion 2504 so as to be engageable with the upper guide 2101, and abuts on the upper surface of the upper guide 2101 to regulate further lowering of the trailing edge dropping member 250A. The engagement recess portion 2502 is formed so as to be separated from the second protrusion portion 2405 in this state. Therefore, the trailing edge dropping member 250A is in a state in which the engagement state with the reversing paddle 240A is released, and is in a state of being positioned at the lower position by the positioning portion 2503.

As a result, even when the reversing paddle 240A reaches the return position, the trailing edge dropping member 250A is positioned at the lower position without being further lowered due to the engagement between the positioning portion 2503 and the upper guide 2101. In such a state, as illustrated in FIG. 10B, the reversing paddle 240A and the trailing edge dropping member 250A move to the return position and the lower position, and the upper discharge roller 230A is located at the home position.

The protruding portion 2504 and the positioning portion 2053 described above illustrated in FIG. 11C are not illustrated in FIGS. 1 to 10B. Such a protruding portion 2504 and the positioning portion 2053 may be omitted, and in this case, another positioning mechanism may be provided to perform positioning of the trailing edge dropping member 250A to the lower position. For example, the positioning may be performed by engaging the engagement recess portion 2502 and the second protrusion portion 2405 at the lower position.

Figure 11B:
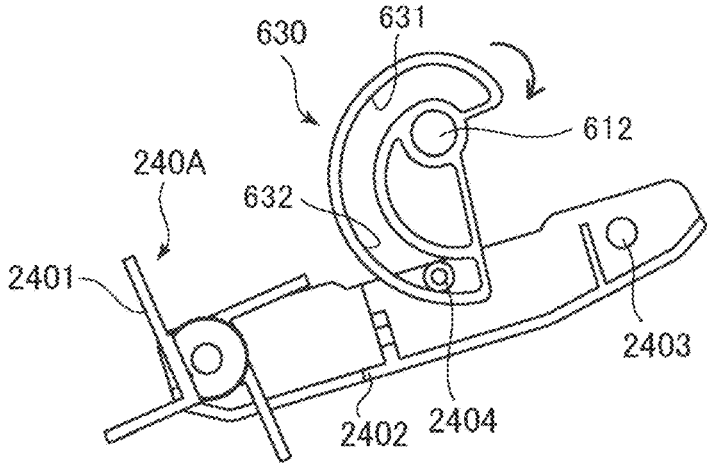
FIG. 11B is a diagram of a state of the reversing paddle at the time of sheet reverse conveying of the sheet processing apparatus according to the embodiment as viewed from the width direction.
Figure 11C:
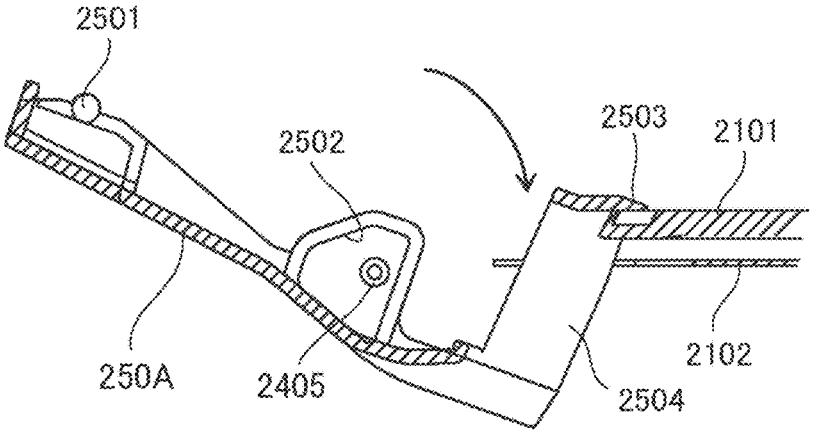
FIG. 11C is a diagram of a state of the trailing edge dropping member at the time of sheet reverse conveying of the sheet processing apparatus according to the embodiment as viewed from the width direction.

When the reversing paddle 240A and the trailing edge dropping member 250A are raised, the processing motor 610 is driven to rotate the rotation shaft 612 in the first direction (counterclockwise direction in FIGS. 11A and 11B). Then, the second cam member 630 rotates in the same direction together with the rotation shaft 612, the first protrusion portion 2404 moves along the inner cam surface 632, and the reversing paddle 240A rises. At this time, the second protrusion portion 2405 is again engaged with the engagement recess portion 2052, and the trailing edge dropping member 250A is also lifted by this engagement. Then, the reversing paddle 240A and the trailing edge dropping member 250A return to the home positions illustrated in FIGS. 5A to 6C.

Here, when the upper discharge roller 230A returns from the state of FIG. 11A to the state of FIG. 6A, the protrusion portion 2303 moves along the inner cam surface 622 of the first cam member 620. At this time, the inner cam surface 622 is formed so that the distance from the center of the rotation shaft 612 to the position where the inner cam surface 622 abuts on the protrusion portion 2303 does not change. Therefore, the upper discharge roller 230A remains at the home position.

In the present embodiment as described above, when the rotation shaft 612 rotates counterclockwise in FIGS. 6A to 6C from the home position, the upper discharge roller 230A descends, and the reversing paddle 240A and the trailing edge dropping member 250A are maintained at the home positions. On the other hand, when the rotation shaft 612 rotates clockwise in FIGS. 6A to 6C from the home position, the upper discharge roller 230A is maintained at the home position, and the reversing paddle 240A and the trailing edge dropping member 250A descend.

Further, when the rotation shaft 612 rotates clockwise in FIGS. 9A to 9C in a state where the upper discharge roller 230A is at the nip position illustrated in FIG. 9A, the upper discharge roller 230A is lifted, and the reversing paddle 240A and the trailing edge dropping member 250A are maintained at the home positions. On the other hand, when the rotation shaft 612 rotates counterclockwise in FIGS. 11A to 11C in a state where the reversing paddle 240A and the trailing edge dropping member 250A are at the return position and the lower position, the upper discharge roller 230A is maintained at the home position, and the reversing paddle 240A and the trailing edge dropping member 250A are lifted.

Track of Trailing Edge Dropping Member

The trailing edge dropping member 250A moves from the upper position to the lower position as described above, thereby dropping the sheet conveyed by the pre-processing rollers 211A and 212A onto the processing tray 220. Here, in a case where the distal end (upstream end in the first conveyance direction) of the trailing edge dropping member passes through the downstream side in the first conveyance direction of the pre-processing nip portion 211*a*, there is a concern that the trailing edge of the sheet may remain in the pre-processing nip portion 211*a*. For example, when the trailing edge of the sheet is curled downward and conveyed, there is a concern that a curled portion of the sheet is leaned against the pre-processing roller 212A below. In this state, even if the sheet is hit from above by the trailing edge dropping member 250A in which the track of the distal end passes through the downstream side of the pre-processing nip portion 211*a*, there is a concern that the trailing edge of the sheet does not come out of the pre-processing nip portion 211*a* and remains in the pre-processing nip portion 211*a*.

Figure 12A:
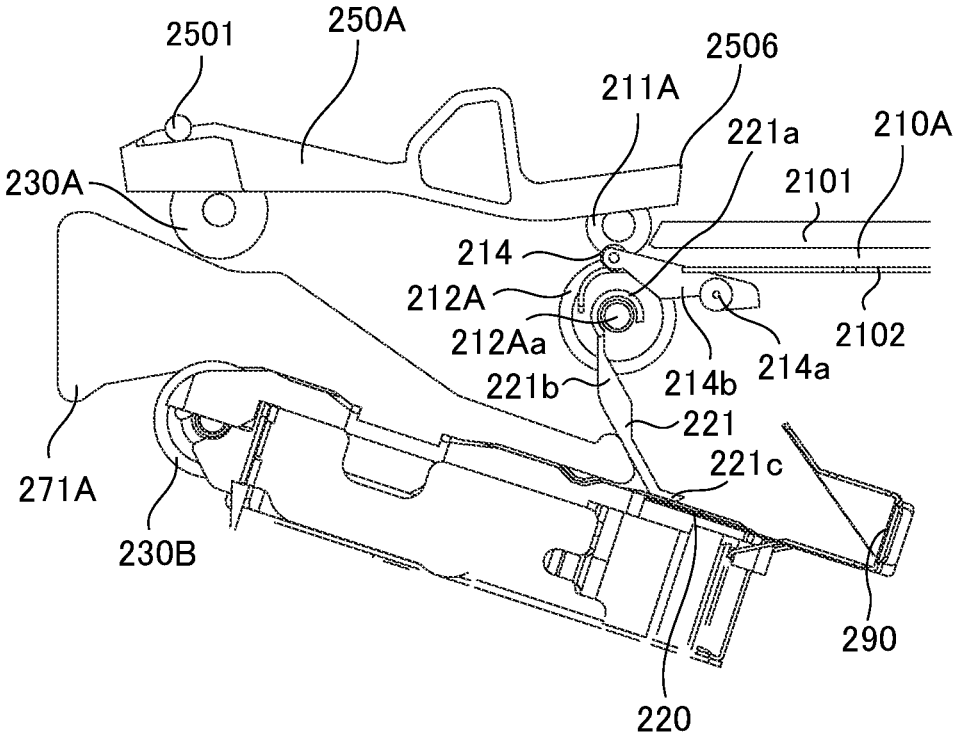
FIG. 12A is a diagram of an upper configuration of the processing tray of the embodiment as viewed from the width direction and illustrates a state in which the trailing edge dropping member is at an upper position.
Figure 12B:
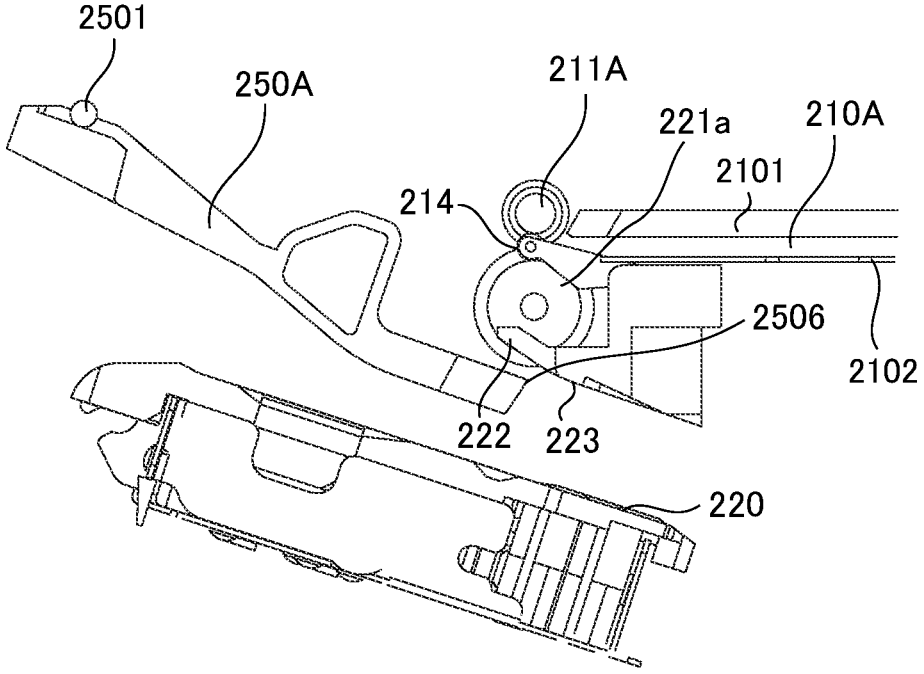
FIG. 12B is a diagram of the upper configuration of the processing tray of the embodiment as viewed from the width direction and illustrates a state in which the trailing edge dropping member is at a lower position.

Therefore, in the present embodiment, as illustrated in FIGS. 12A and 12B, when viewed from a rotational axis direction of the pre-processing rollers 211A and 212A serving as a pair of conveying rollers, the trailing edge dropping member 250A is disposed such that a pivot locus of the trailing edge dropping member 250A the nip position on a most downstream side in the first conveyance direction in the nip area where the sheet is nipped by the pre-processing rollers 211A and 212A. That is, the pre-processing nip portion 211*a* that nips the sheet by the pre-processing rollers 211A and 212A has a nip area having a certain width in the conveyance direction of the sheet due to elastic deformation of the rollers. The distal end (upstream end in the first conveyance direction) 2506 of the trailing edge dropping member 250A is disposed so as to pass through at least the most downstream end in the first conveyance direction in the nip area.

In the present embodiment, the trailing edge dropping member 250A extends from the pivot shaft 2501 toward the upstream side in the first conveyance direction, and the distal end 2506 thereof is located on the upstream side in the first conveyance direction with respect to the pre-processing nip portion 211*a* when passing through the pre-processing nip portion 211*a*. That is, the trailing edge dropping member 250A passes through the entire nip area.

In the present embodiment, as illustrated in FIG. 12A, in a state where the trailing edge dropping member 250A is located at the upper position, the distal end 2506 of the trailing edge dropping member 250A is located on the upstream side of the pre-processing nip portion 211*a* in the first conveyance direction. When the trailing edge dropping member 250A moves from the upper position to the lower position, the portion on the distal end side of the trailing edge dropping member 250A passes through the same position as the pre-processing nip portion 211*a* in the first conveyance direction, in other words, the position where the portion on the distal end side of the trailing edge dropping member 250A overlaps the pre-processing nip portion 211*a* when viewed from the width direction.

In the lower position illustrated in FIG. 12B, the distal end 2506 of the trailing edge dropping member 250A may be located on the upstream side or the downstream side in the first conveyance direction with respect to the pre-processing nip portion 211*a*. Of course, the first conveyance direction may be located at the same position as any position in the nip area of the pre-processing nip portion 211*a*. The same applies to the case of the upper position in FIG. 12A. That is, when the trailing edge dropping member 250A moves from the upper position to the lower position, a part of the trailing edge dropping member 250A may be configured to pass through the most downstream position in the nip area of the pre-processing nip portion 211*a* in the first conveyance direction.

In order to more reliably drop the trailing edge of the sheet remaining in the pre-processing nip portion 211*a*, preferably, the distal end 2506 of the trailing edge dropping member 250A is disposed so as to pass through the central portion of the nip area in the first conveyance direction, and more preferably, the distal end 2506 is disposed so as to pass through the upstream side of the center of the nip area in the first conveyance direction. In the present embodiment, as described above, the trailing edge dropping member 250A passes through the entire nip area.

Central Guide Member

Figure 17:
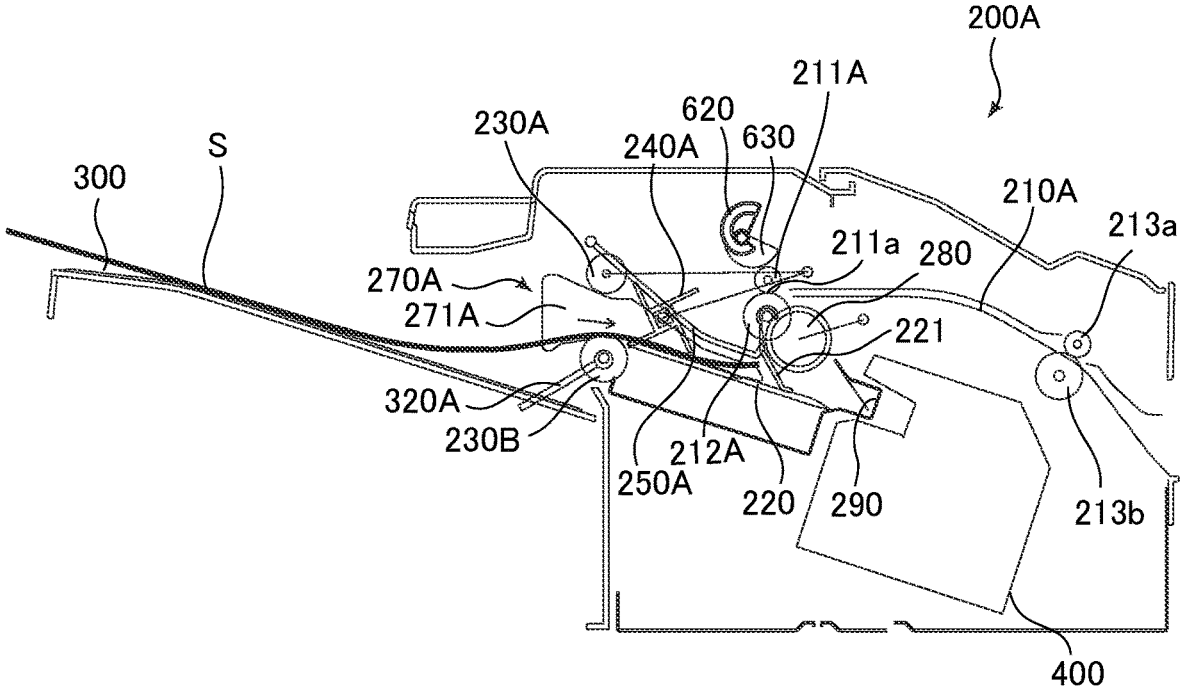
FIG. 17 is a cross-sectional view illustrating a state in which a trailing edge of a sheet is dropped in the sheet processing apparatus according to the embodiment.

In addition, in the case of the present embodiment, as illustrated in FIG. 12A and FIG. 17 to be described below, a central guide member 221 serving as a guide portion or a first guide portion that is arranged above the processing tray 220, extends toward the processing tray 220 and guides the sheet on the processing tray 220 conveyed in the second conveyance direction by the reversing paddle 240A is provided. The central guide member 221 is swingably supported with respect to a rotation shaft 212Aa of the lower pre-processing roller 212A, and is disposed so as to hang downward from the rotation shaft 212Aa.

The central guide member 221 includes a supporting portion 221*a* supported by the rotation shaft 212Aa, an arm portion 221*b* extending downward from the supporting portion 221*a*, and a guide portion 221*c* provided to be bent from a lower end of the arm portion 221*b* toward the upstream side in the first conveyance direction. The supporting portion 221*a* is formed in a partially notched annular shape so as to be hooked on the rotation shaft 212Aa. The arm portion 221*b* is inclined so as to be inclined toward the upstream side in the first conveyance direction as it goes downward from the supporting portion 221*a*. The guide portion 221*c* is provided such that the lower surface thereof is substantially parallel to the sheet supporting surface of the processing tray 220.

The central guide member 221 guides the central portion of the trailing edge of the sheet by bringing the guide portion 221*c* into contact with the upper surface at the center in the width direction of the sheet conveyed in the second conveyance direction toward the trailing edge regulation member 290 by the reversing paddle 240A. Then, the sheet is smoothly moved toward the knurled belt 281 of the return member 280 and the trailing edge regulation member 290. In the present embodiment, the trailing edge dropping member 250A is disposed at the lower position so as to overlap a part of the central guide member 221 when viewed from the rotational axis direction of the pre-processing rollers 211A and 212A. This point will be described below.

Stiffening Member

Figure 14:
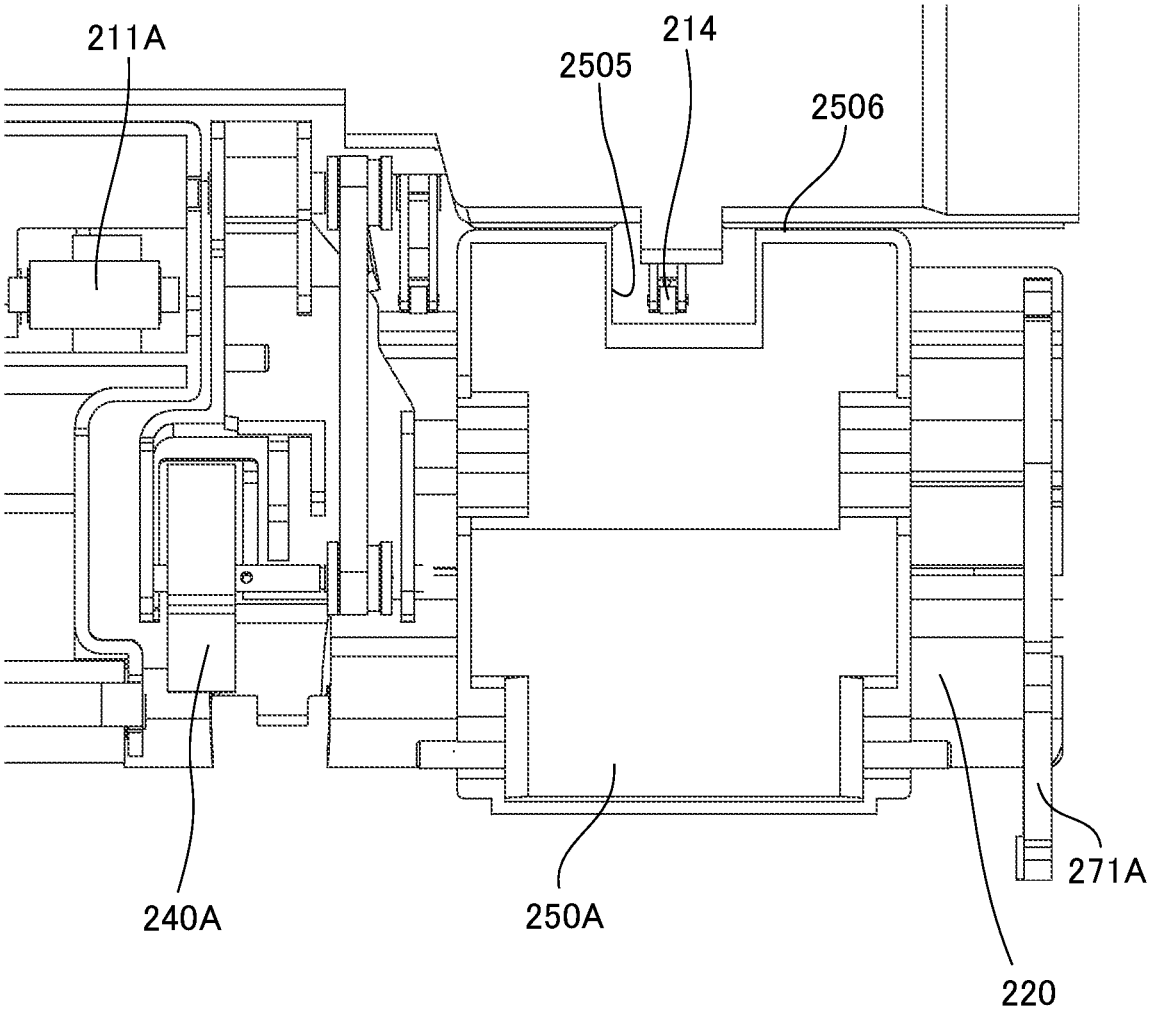
FIG. 14 is a plan view of a periphery of the trailing edge dropping member of the embodiment as viewed from above.

As illustrated in FIG. 14, the trailing edge dropping member 250A is located at a position deviated from the pre-processing rollers 211A and 212A in the rotational axis direction of the pre-processing roller 211A (the width direction of the sheet). Therefore, even if the track of the trailing edge dropping member 250A is a track passing through the pre-processing nip portion 211*a*, the trailing edge dropping member 250A and the pre-processing rollers 211A and 212A do not interfere with each other.

Figure 13A:
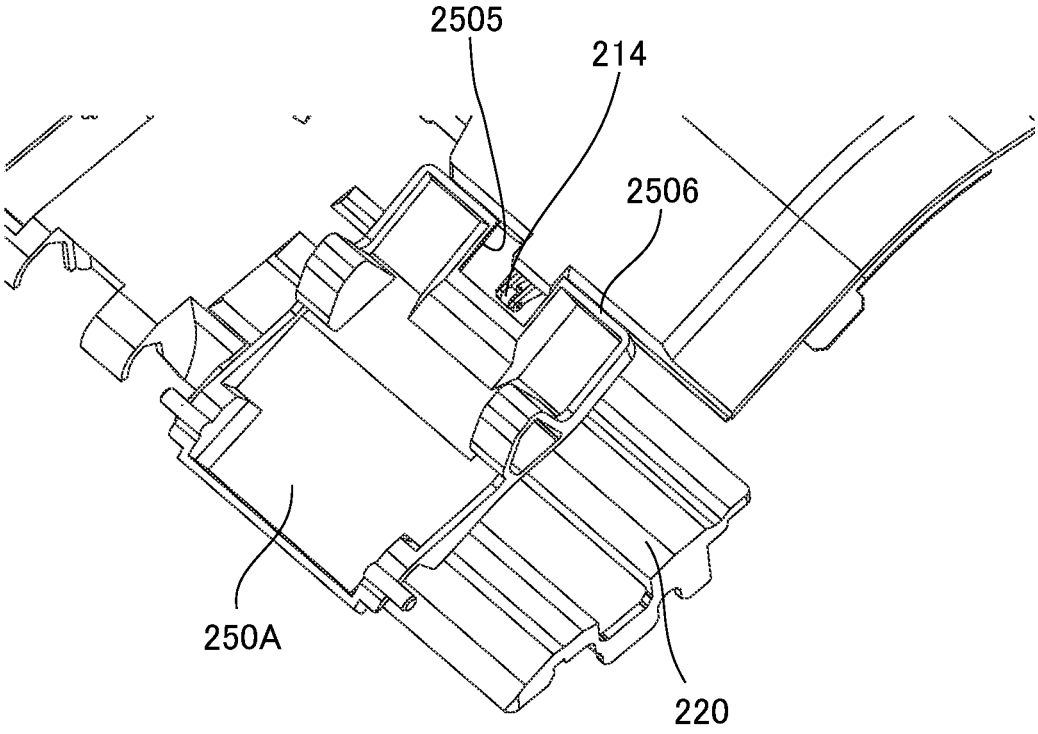
FIG. 13A is a perspective view of the trailing edge dropping member of the embodiment as viewed from above and illustrates a state in which the trailing edge dropping member is at the upper position.

On the other hand, as illustrated in FIGS. 12A and 13A, a pair of stiffening members (stiffening portions) 214 for imparting stiffness to the sheet is disposed on both sides in the width direction of the pre-processing rollers 211A and 212A, and the stiffening members 214 are at positions overlapping the trailing edge dropping member 250A in the width direction. Therefore, the trailing edge dropping member 250A is provided with a recess portion 2505 at the distal end portion so as not to interfere with the stiffening member 214 at the time of pivoting. This will be described in detail.

First, the stiffening members 214 are disposed on both sides of the pre-processing rollers 211A and 212A in the rotational axis direction of the pre-processing rollers 211A and 212A so as to abut on the lower surface of the sheet conveyed by the pre-processing rollers 211A and 212A above the pre-processing nip portion 211*a*. Specifically, the stiffening member 214 is a roller that is provided at a distal end of a stiffness arm portion 214*b* being supported by the pivot shaft 214*a* disposed below the lower guide 2102 of the conveyance path 210A and extending from the pivot shaft 214*a* toward the downstream side in the first conveyance direction.

Such a stiffening member 214 is pivotable in the vertical direction about the pivot shaft 214*a*, is biased upward by a spring (not illustrated), and is partially located above the pre-processing nip portion 211*a* before sheet conveyance. Then, the stiffening member 214 pushes up the lower surface of the sheet passing through the pre-processing nip portion 211*a* and bends the sheet to apply stiffness to the sheet. In particular, by applying stiffness to a sheet having weak stiffness such as thin paper, the leading edge of the sheet passing through the pre-processing nip portion 211*a* is prevented from drooping. On the other hand, for a sheet having strong stiffness such as thick paper, the stiffening member 214 retracts downward to allow the thick paper to pass through the pre-processing nip portion 211*a*.

As described above, since the trailing edge dropping member 250A is disposed so as to pass through the pre-processing nip portion 211*a* when viewed from the width direction, the trailing edge dropping member passes through a position that interferes with the stiffening members 214 located on both sides of the pre-processing nip portion 211*a* in the width direction. Therefore, a recess portion (notch) 2505 formed so as to open to the distal end side is provided at the distal end portion of the trailing edge dropping member 250A, and the stiffening member 214 can pass through the recess portion 2505 when the trailing edge dropping member 250A moves to the lower position.

End-Side Guide Member

The trailing edge dropping member 250A also serves to guide the sheet on the processing tray 220. That is, the sheet is dropped onto the processing tray 220 by the trailing edge dropping member 250A and then conveyed in the second conveyance direction toward the trailing edge regulation member 290 by the reversing paddle 240A. At this time, the upper surface of the sheet is guided by the lower surface of the trailing edge dropping member 250A to smoothly move the sheet toward the knurled belt 281 and the trailing edge regulation member 290. However, in a case where the recess portion 2505 is provided at the distal end portion of the trailing edge dropping member 250A as described above, there is a possibility that the end portion of the sheet conveyed on the processing tray 220 enters the recess portion 2505. Then, there is a possibility that a jam occurs due to, for example, contact of an end portion of the sheet with any surrounding member.

Figure 13B:
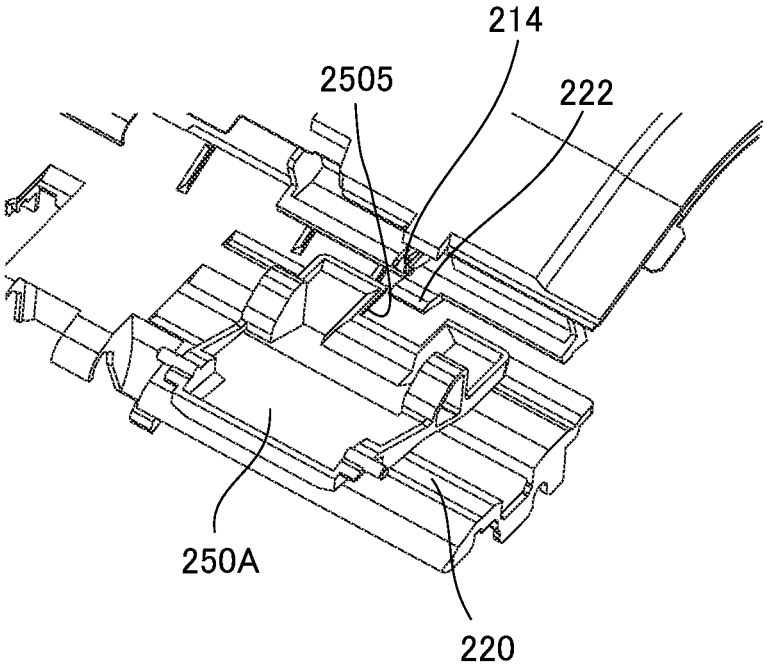
FIG. 13B is a perspective view of the trailing edge dropping member of the embodiment as viewed from above and illustrates a state in which the trailing edge dropping member is at the lower position.

Therefore, in the present embodiment, as illustrated in FIGS. 12B and 13B, an end-side guide member 222 serving as a second guide portion that is disposed below each of the pair of stiffening members 214 and guides the sheet on the processing tray 220 conveyed in the second conveyance direction by the reversing paddle 240A is provided. Here, trailing edge guides 223 are provided below the lower guide 2102 of the conveyance path 210A and above both sides in the width direction of the processing tray 220, respectively. The trailing edge guide 223 is located on the upstream side in the first conveyance direction of the trailing edge dropping member 250A located at the lower position, and guides the trailing edge of the sheet conveyed on the processing tray 220 in the second conveyance direction.

As described above, when the recess portion 2505 is not provided at the distal end of the trailing edge dropping member 250A, the sheet guided by the lower surface of the trailing edge dropping member 250A can be smoothly delivered to the trailing edge guide 223. However, when the recess portion 2505 is formed as described above, for example, there is a possibility that a corner of the sheet enters the recess portion 2505 and a jam occurs. Therefore, in the present embodiment, the end-side guide member 222 is provided so as to protrude from the downstream end of the trailing edge guide 223 in the first conveyance direction. The end-side guide member 222 is disposed at a position aligned with the recess portion 2505 in the width direction. That is, the end-side guide member 222 is disposed below the stiffening member 214. Therefore, the end-side guide member 222 can also pass through the recess portion 2505.

As described above, by extending the end-side guide member 222 at the position corresponding to the recess portion 2505, the sheet can be guided by the end-side guide member 222 even if the recess portion 2505 is formed at the distal end portion of the trailing edge dropping member 250A. For example, even when a corner of the sheet conveyed on the processing tray 220 toward the second conveyance direction enters the recess portion 2505, the corner is guided by the end-side guide member 222. The lower surface of the end-side guide member 222 and the lower surface of the trailing edge guide 223 are smoothly continuous, and when the sheet is further conveyed in the second conveyance direction, the corner of the sheet can be smoothly delivered from the end-side guide member 222 to the trailing edge guide 223.

In the present embodiment, as described above, the center portion of the sheet in the width direction is guided by the central guide member 221, and the end portion side of the sheet in the width direction is guided by the end-side guide member 222, so that it is possible to prevent the sheet conveyed on the processing tray 220 in the second conveyance direction from being jammed.

Inclined Surface

Figure 15A:
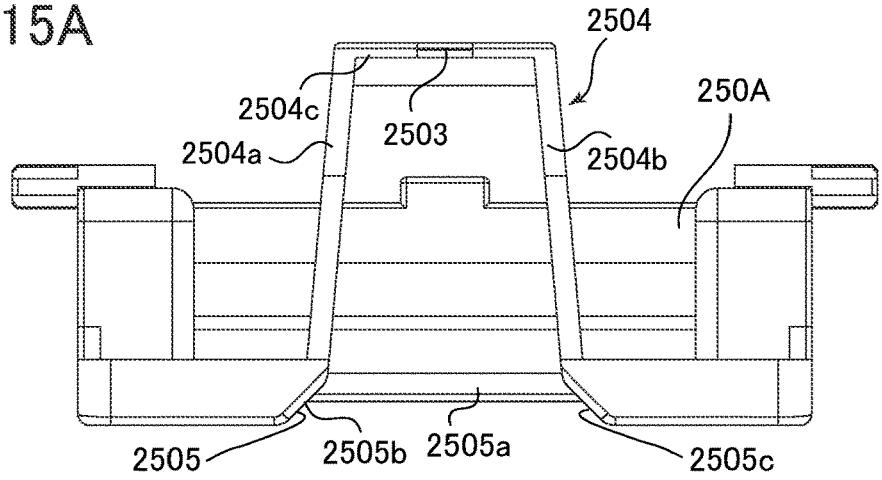
FIG. 15A is a diagram of the trailing edge dropping member of the embodiment as viewed from an upstream side in a first conveyance direction.
Figure 15B:
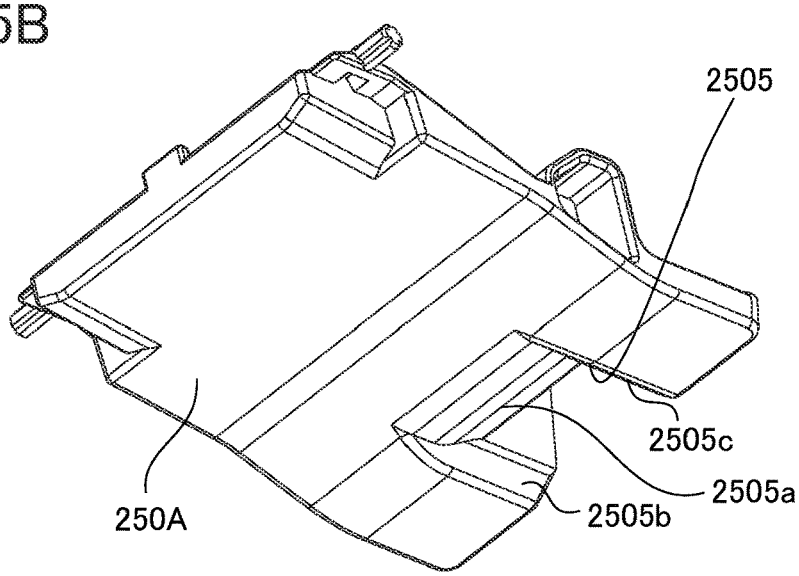
FIG. 15B is a perspective view of the trailing edge dropping member of the embodiment as viewed from below.
Figure 15C:
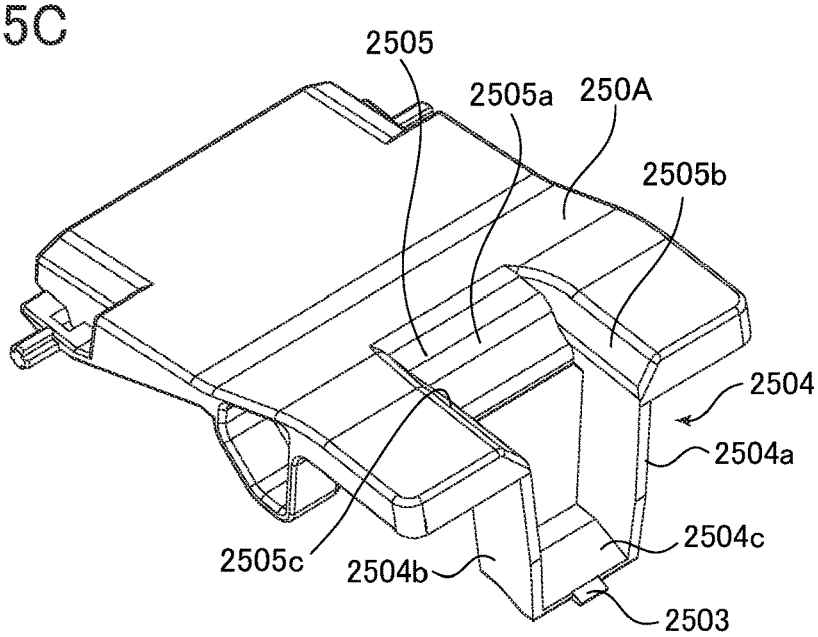
FIG. 15C is a perspective view of the trailing edge dropping member of the embodiment as viewed from above.

In the present embodiment, as described above, the respective surfaces of the recess portion 2505 are inclined surfaces 2505*a*, 2505*b*, and 2505*c* as illustrated in FIGS. 15A to 15C in order to prevent the sheet from being caught in the recess portion 2505 even if the end portion of the sheet enters the recess portion 2505. That is, the recess portion 2505 has a first surface on the downstream side in the first conveyance direction, and a second surface and a third surface facing each other in the width direction intersecting the first conveyance direction. The first surface is an inclined surface 2505*a* inclined toward the upstream side in the first conveyance direction as the first surface extends upward. The second surface and the third surface are inclined surfaces 2505*b* and 2505*c* inclined in a direction closer to each other as the second surface and the third surface extend upward.

By forming the inner surface of the recess portion 2505 as the inclined surfaces 2505*a*, 2505*b*, and 2505*c*, when the sheet moves in a state where the end portion of the sheet enters the recess portion 2505 from below, the portion that has entered is easily guided downward by any of the inclined surfaces. As a result, it is possible to prevent the sheet from being caught in the recess portion 2505.

As described above, the trailing edge dropping member 250A is provided with the protruding portion 2504. The protruding portion 2504 is provided so as to protrude above the recess portion 2505 and to extend above the upper ends of the inclined surfaces 2505*b* and 2505*c* on both sides in the width direction of the recess portion 2505. That is, the protruding portion 2504 is formed of side wall portions 2504*a* and 2504*b* on both sides in the width direction, and a connecting portion 2504*c* connecting upper end portions of the side wall portions 2504*a* and 2504*b*. The positioning portion 2503 described above is provided in the connecting portion 2504*c*.

Figure 16A:
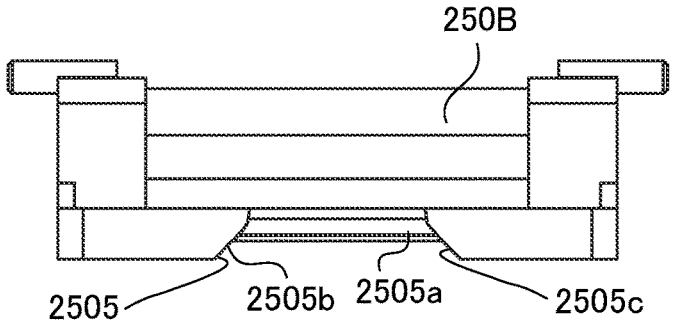
FIG. 16A is a diagram of a trailing edge dropping member of another example of the embodiment as viewed from the upstream side in the first conveyance direction.
Figure 16B:
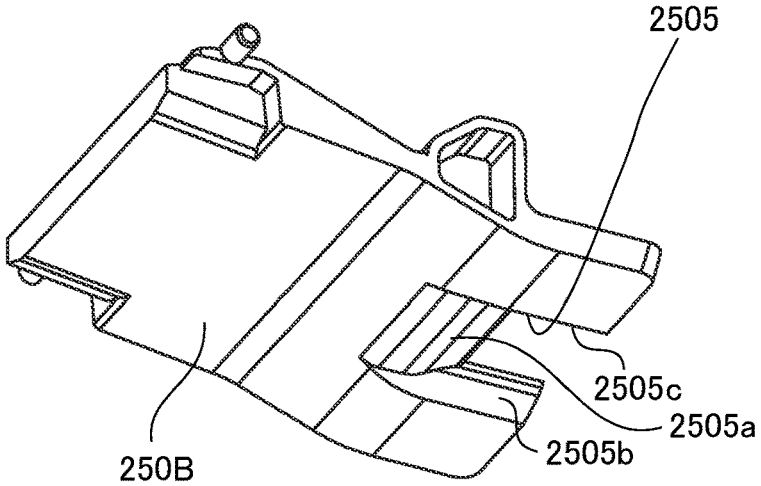
FIG. 16B is a perspective view of the trailing edge dropping member of the other example of the embodiment as viewed from below.
Figure 16C:
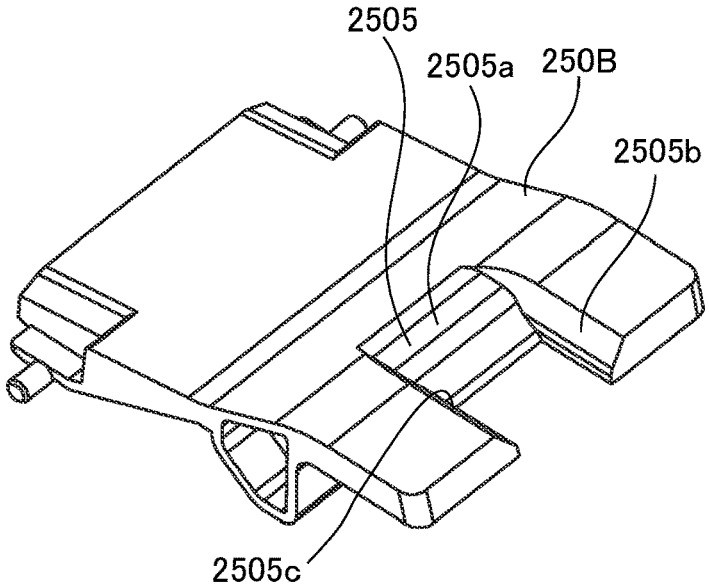
FIG. 16C is a perspective view of the trailing edge dropping member of the other example of the embodiment as viewed from above.

As described above, the protruding portion 2504 also serves to regulate the leading edge of the sheet conveyed toward the pre-processing nip portion 211*a* on the upstream side in the first conveyance direction with respect to the pre-processing nip portion 211*a* in a state where the trailing edge dropping member 250A is at the lower position. In the present embodiment, the side wall portions 2504*a* and 2504*b* regulate the leading edge of the sheet. The protruding portion 2504 may be omitted, and a trailing edge dropping member 250B of another example of the present embodiment in which the protruding portion 2504 is omitted is illustrated in FIGS. 16A to 16C. The trailing edge dropping member 250B has the same configuration as the trailing edge dropping member 250A except that the protruding portion 2504 and the positioning portion 2503 are not provided.

Relationship Between Trailing Edge Dropping Member and Central Guide Member

As described above, the trailing edge dropping member 250A is disposed at the lower position so as to overlap a part of the central guide member 221 when viewed from the rotational axis direction of the pre-processing rollers 211A and 212A. As a result, as illustrated in FIG. 17, there is no gap between the trailing edge dropping member 250A and the central guide member 221 at the lower position, and it is possible to suppress the sheet from being caught by the central guide member 221 and the trailing edge dropping member 250A. Hereinafter, a specific description will be given.

Figure 18:
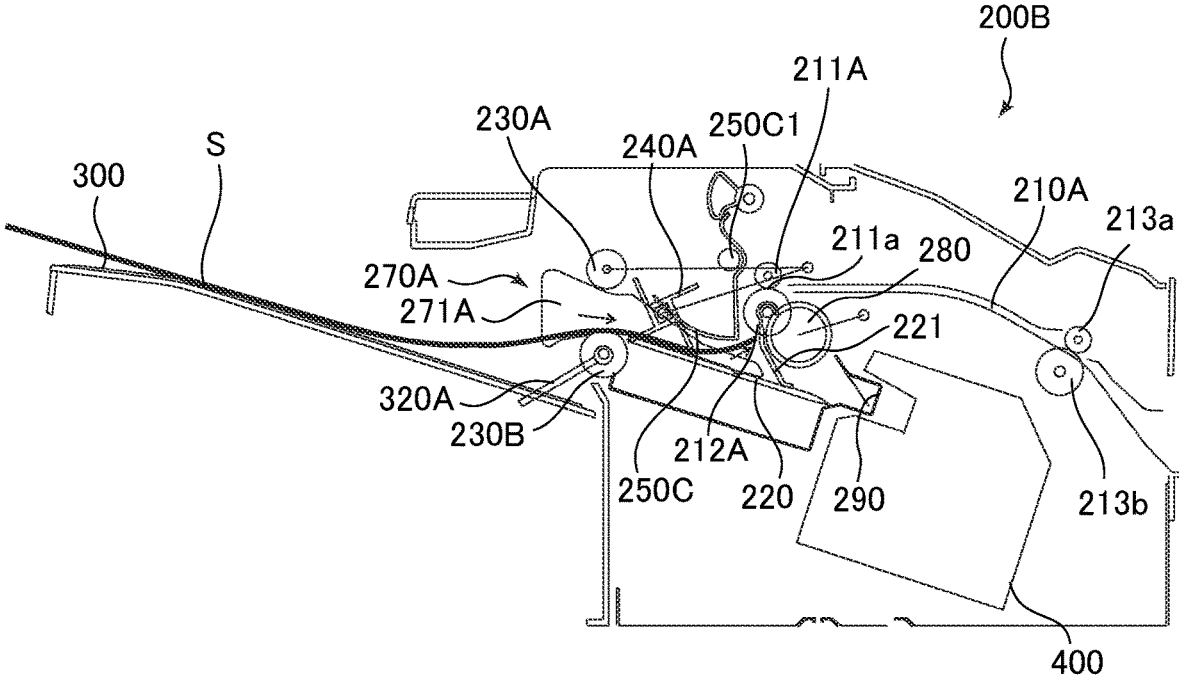
FIG. 18 is a cross-sectional view illustrating a state in which a trailing edge of a sheet is dropped in a sheet processing apparatus according to a comparative example.

FIG. 18 illustrates a cross-sectional view of a sheet processing apparatus 200B according to a comparative example. In the case of the comparative example, a pivot axis 250C1 of a trailing edge dropping member 250C is disposed on the downstream side with respect to the pre-processing rollers 211A and 212A in the conveyance direction of the sheet by the pre-processing rollers 211A and 212A, and when the sheet conveyed by the pre-processing rollers 211A and 212A is dropped downward, the distal end (upstream end in the conveyance direction) of the trailing edge dropping member 250C pivots about the pivot axis 250C1 from the upper position toward the lower position on the downstream side of the pre-processing rollers 211A and 212A. Then, there is a gap between the central guide member 221 and the trailing edge dropping member 250C in a state where the trailing edge dropping member 250C is at the lower position (state of FIG. 18).

If there is such a gap, for example, when the trailing edge of a sheet S is curled upward, there is a possibility that the trailing edge of the sheet may enter this gap and a jam occurs. On the other hand, in the present embodiment, as illustrated in FIG. 17, since there is no gap between the trailing edge dropping member 250A and the central guide member 221 at the lower position, even when the trailing edge of the sheet S is curled upward, it is possible to prevent the trailing edge of the sheet from being caught by the central guide member 221 and the trailing edge dropping member 250A.

As described above, in the present embodiment, when viewed from the rotational axis direction of the pre-processing rollers 211A and 212A serving as a pair of conveying rollers, the trailing edge dropping member 250A is disposed such that the pivot locus of the trailing edge dropping member 250A the nip position on the most downstream side in the first conveyance direction in the nip area where the sheet is nipped by the pre-processing rollers 211A and 212A. Therefore, the remaining trailing edge of the sheet can be prevented. For example, when the trailing edge of the sheet is curled downward and conveyed, there is a concern that a curled portion of the sheet is leaned against the pre-processing roller 212A below. Even in such a case, since the trailing edge dropping member 250A moves so as to pass through the pre-processing nip portion 211 when viewed from the width direction, the trailing edge of the sheet remaining in the pre-processing nip portion 211*a* can be hit by the trailing edge dropping member 250A. Therefore, it is possible to prevent the trailing edge of the sheet from remaining in the pre-processing nip portion 211*a*.

Leading Edge Regulation of Sheet

The trailing edge dropping member 250A moves from the upper position to the lower position as described above, thereby dropping the sheet conveyed by the pre-processing rollers 211A and 212A onto the processing tray 220. Here, there is a possibility that the trailing edge dropping member 250A cannot return from the lower position to the upper position due to a failure of a mechanism for operating the trailing edge dropping member 250A or the like. If the trailing edge dropping member 250A cannot return to the upper position, the next conveyed sheet hits the trailing edge dropping member 250A, and the sheet is jammed downstream of the pre-processing rollers 211A and 212A in the first conveyance direction. As described above, it is difficult to remove the jammed sheet downstream of the pre-processing rollers 211A and 212A in the first conveyance direction with the trailing edge dropping member 250A at the lower position.

Specifically, in a case where the trailing edge dropping member 250A is at the lower position, the upper space of the processing tray 220 becomes narrow, and it is difficult for a finger or the like to enter. In addition, since a mechanism for operating the trailing edge dropping member 250A and the like is disposed above the processing tray 220, it is difficult to access the space between the pre-processing rollers 211A and 212A and the trailing edge dropping member 250A from above. Furthermore, since the sheet is jammed downstream of the pre-processing rollers 211A and 212A in the first conveyance direction, even if the pre-processing rollers 211A and 212A are manually rotated to return the sheet to the upstream side with respect to the pre-processing rollers 211A and 212A, in a case where the trailing edge of the sheet passes through the upstream rollers 213*a* and 213*b* on the upstream side with respect to the pre-processing rollers 211A and 212A, it is difficult to return the sheet to the inlet of the sheet processing apparatus 200A.

Therefore, in the present embodiment, in a state where the trailing edge dropping member 250A is located at the lower position, the leading edge of the sheet conveyed toward the nip position is restricted on the upstream side in the first conveyance direction with respect to the nip position on the most downstream side in the first conveyance direction in the nip area where the sheet is nipped by the pre-processing rollers 211A and 212A. That is, the pre-processing nip portion 211*a* that nips the sheet by the pre-processing rollers 211A and 212A has a nip area having a certain width in the conveyance direction of the sheet due to elastic deformation of the rollers. The position where the leading edge of the sheet is restricted is located upstream in the first conveyance direction from at least the most downstream end in the first conveyance direction in the nip area.

Specifically, the paddle arm 2402 of the reversing paddle 240A that descends in conjunction with the trailing edge dropping member 250A is positioned on the upstream side of the pre-processing nip portion 211*a* in the first conveyance direction at the return position, and the leading edge of the sheet is restricted by the paddle arm 2402. That is, in the present embodiment, the paddle arm 2402 is provided with the leading edge regulating portion 2407 that regulates movement of the leading edge of the sheet in the first conveyance direction on the upstream side in the first conveyance direction with respect to the nip position. The leading edge regulating portion 2407 is a lower side surface of the paddle arm 2402 in a case where the reversing paddle 240A is located at the upper retracting position. Hereinafter, a specific description will be given with reference to FIGS. 19 to 25B while referring to FIG. 2 and the like. FIGS. 19 to 22 are perspective views and cross-sectional views illustrating a configuration of the conveyance path 210A and the periphery of the processing tray 220. FIG. 23 illustrates a state in which the leading edge of the sheet is regulated by the paddle arm 2402.

Figure 2:
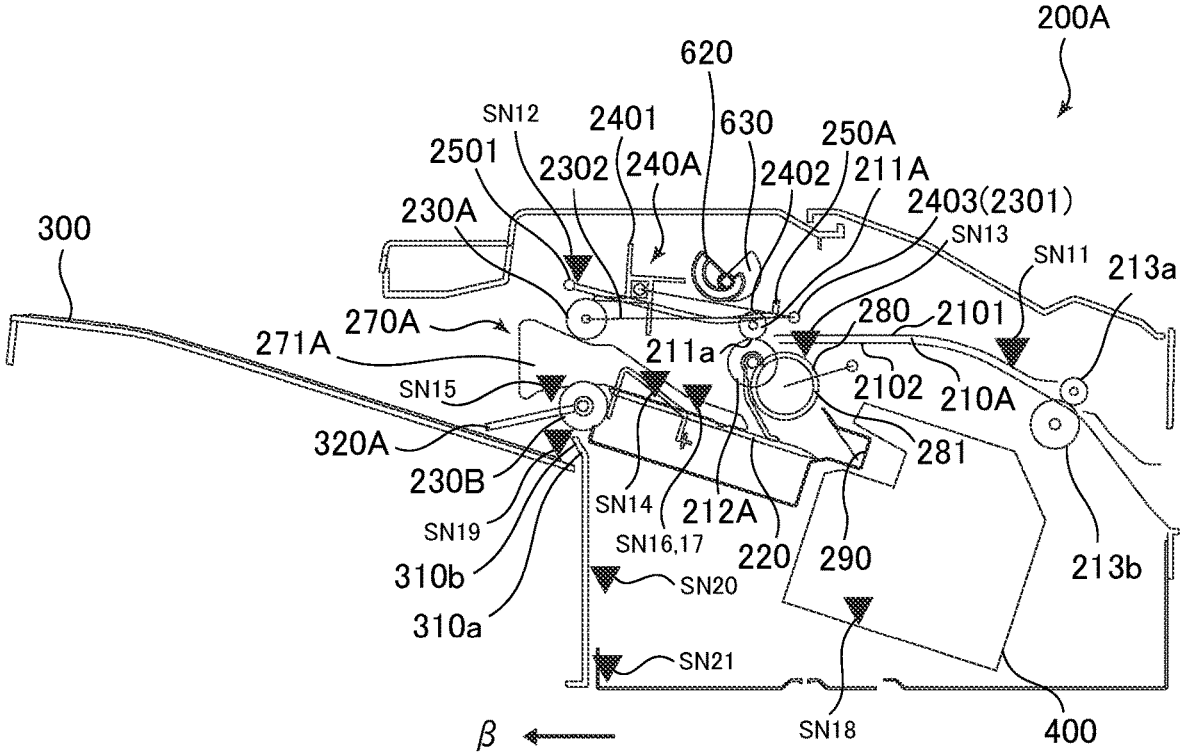
FIG. 2 is a schematic configuration cross-sectional view of a sheet processing apparatus according to the embodiment.

As illustrated in FIG. 2 described above, the reversing paddle 240A is swingable about the swing fulcrum 2403 between a return position where the paddle portion 2401 abuts on the upper surface of the sheet on the processing tray 220 to convey the sheet in the second conveyance direction and an upper retracting position where the paddle portion 2401 is retracted above the return position. The swing fulcrum 2403 is disposed upstream of the nip position in the first conveyance direction and vertically above the nip position. Therefore, when the reversing paddle 240A is located at the return position, as illustrated in FIG. 22, the leading edge regulating portion 2407 of the paddle arm 2402 is located upstream of the nip position in the first conveyance direction.

Here, the reversing paddle 240A is located at a position deviated from the pre-processing rollers 211A and 212A in the rotational axis direction of the pre-processing roller 211A (the width direction of the sheet). Therefore, even if the track of the reversing paddle 240A is a track passing through the pre-processing nip portion 211*a*, the reversing paddle 240A and the pre-processing rollers 211A and 212A do not interfere with each other. Therefore, when the reversing paddle 240A is located at the return position, the leading edge regulating portion 2407 of the paddle arm 2402 can enter the upstream side of the pre-processing nip portion 211*a* in the first conveyance direction.

As described above, the reversing paddle 240A operates together with the pivoting of the trailing edge dropping member 250A, and moves to the upper retracting position and the return position. That is, with the above-described drive configuration 600, the reversing paddle 240A swings in conjunction with the pivoting of the trailing edge dropping member 250A. Then, in a state where the trailing edge dropping member 250A is at the lower position, the reversing paddle 240A is at the return position. The return position is also a regulating position where the leading edge regulating portion 2407 of the paddle arm 2402 regulates the leading edge of the sheet conveyed toward the nip position on the upstream side in the first conveyance direction with respect to the nip position. On the other hand, in a state where the trailing edge dropping member 250A is at the upper position, the reversing paddle 240A is at the upper retracting position. The upper retracting position is a retracting position retracted from the restriction position.

Figure 19:
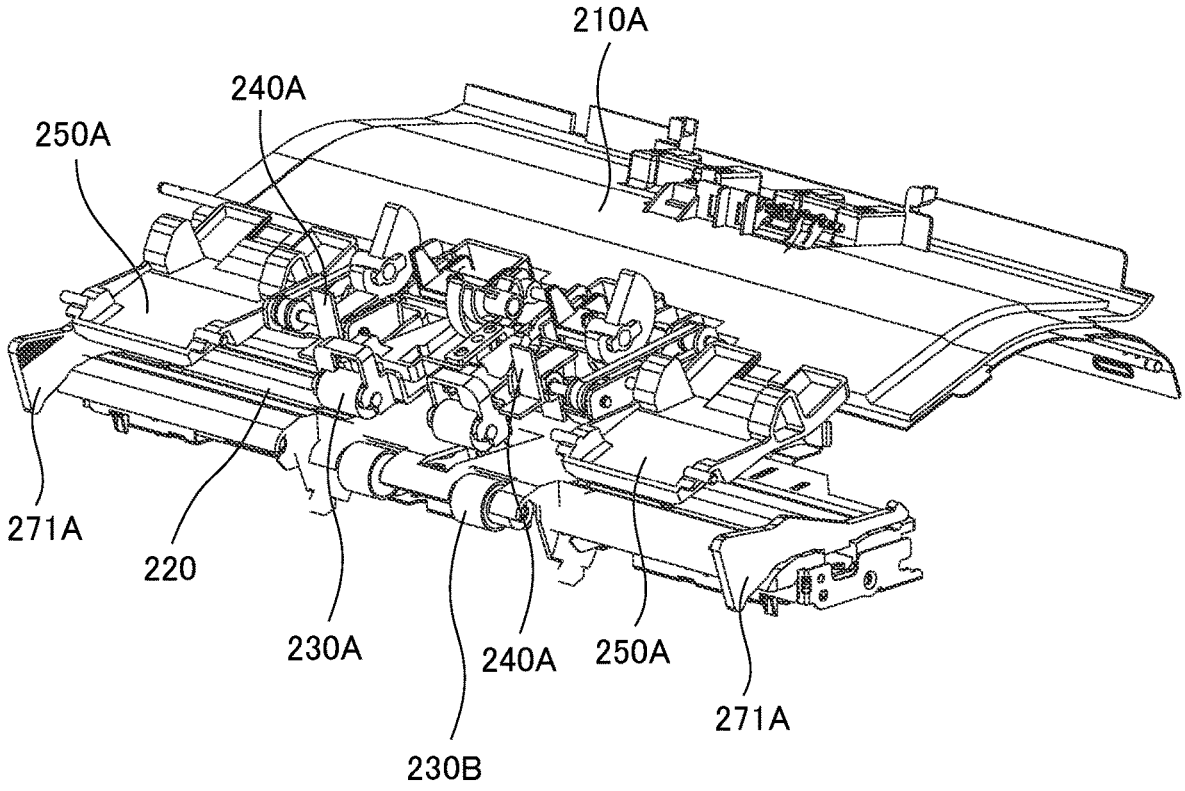
FIG. 19 is a perspective view illustrating a state in which each unit of the sheet processing apparatus according to the embodiment is at the home position with a part of the apparatus omitted.
Figure 20:
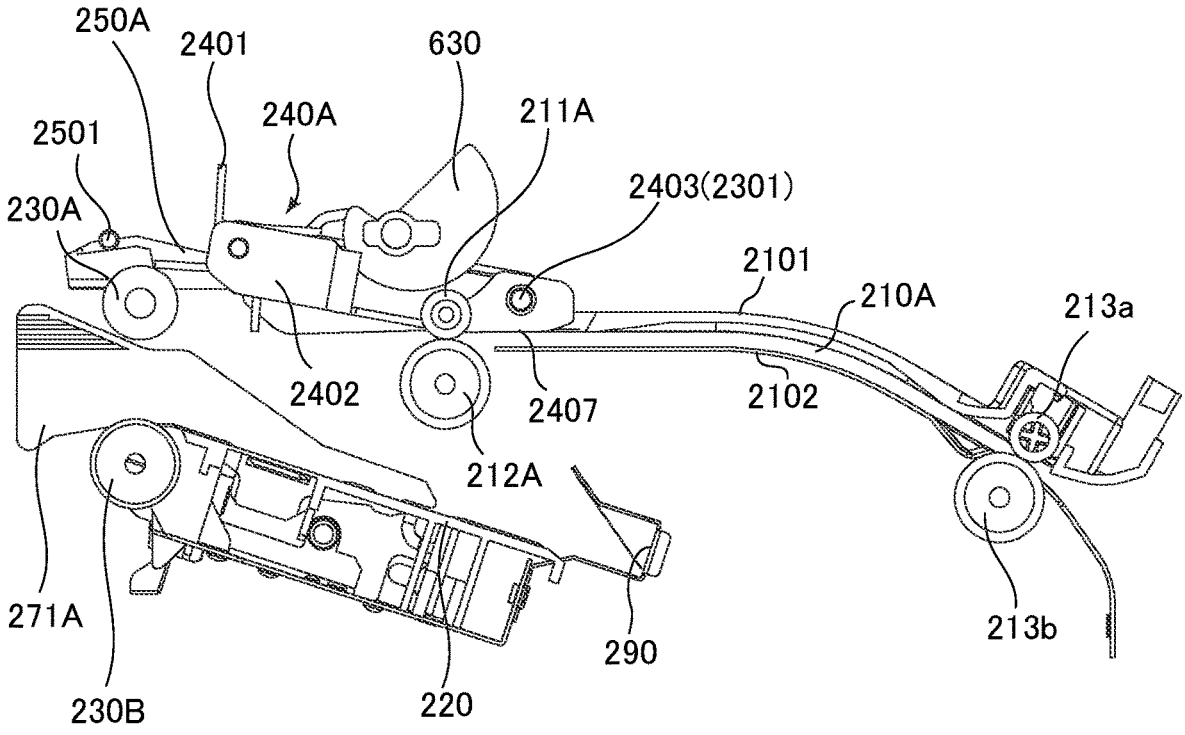
FIG. 20 is a cross-sectional view illustrating the state in which each unit of the sheet processing apparatus according to the embodiment is at the home position with the part of the apparatus omitted.

FIGS. 19 and 20 illustrate a state in which the upper discharge roller 230A, the reversing paddle 240A, and the trailing edge dropping member 250A are at the home positions. That is, the upper discharge roller 230A is located at the retracting position, the reversing paddle 240A is located at the upper retracting position, and the trailing edge dropping member 250A is located at the upper position. In this state, the paddle arm 2402 of the reversing paddle 240A does not enter the conveyance path of the sheet on the upstream side of the pre-processing nip portion 211*a* in the first conveyance direction, and the sheet conveyed from the conveyance path 210A can reach the pre-processing nip portion 211*a*.

Figure 21:
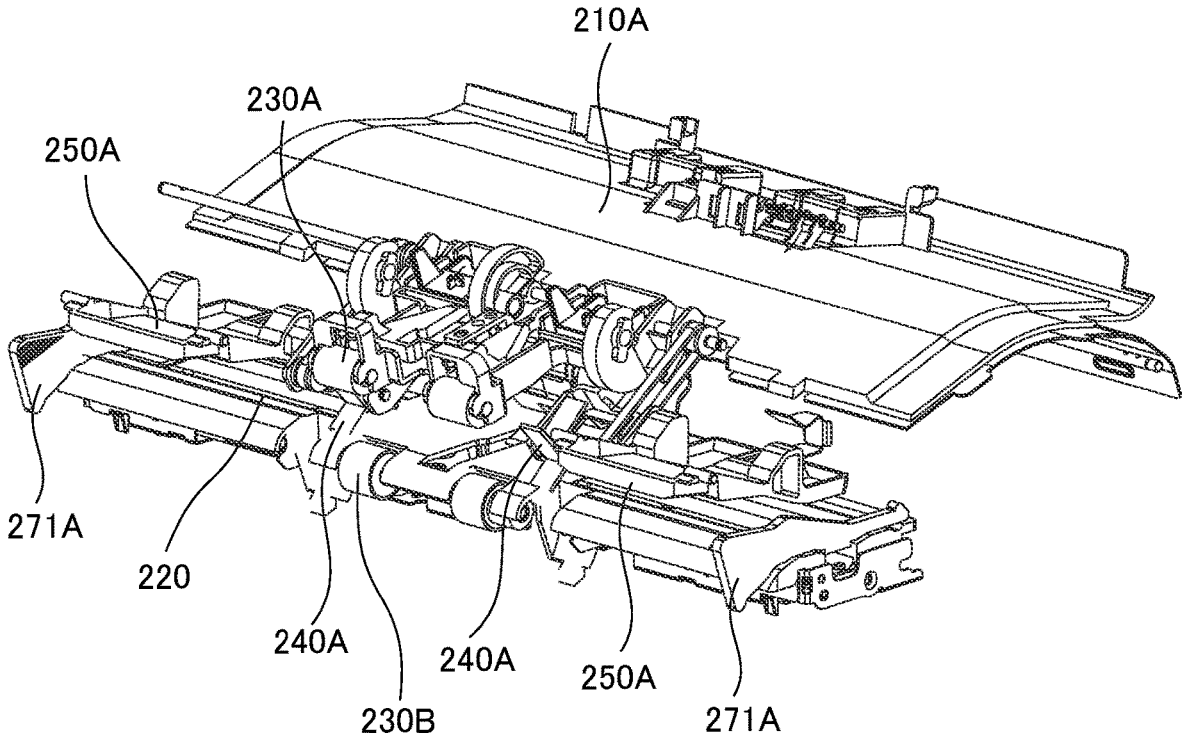
FIG. 21 is a perspective view illustrating a state of the sheet processing apparatus according to the embodiment at the time of sheet reverse conveying, with the part of the apparatus omitted.
Figure 22:
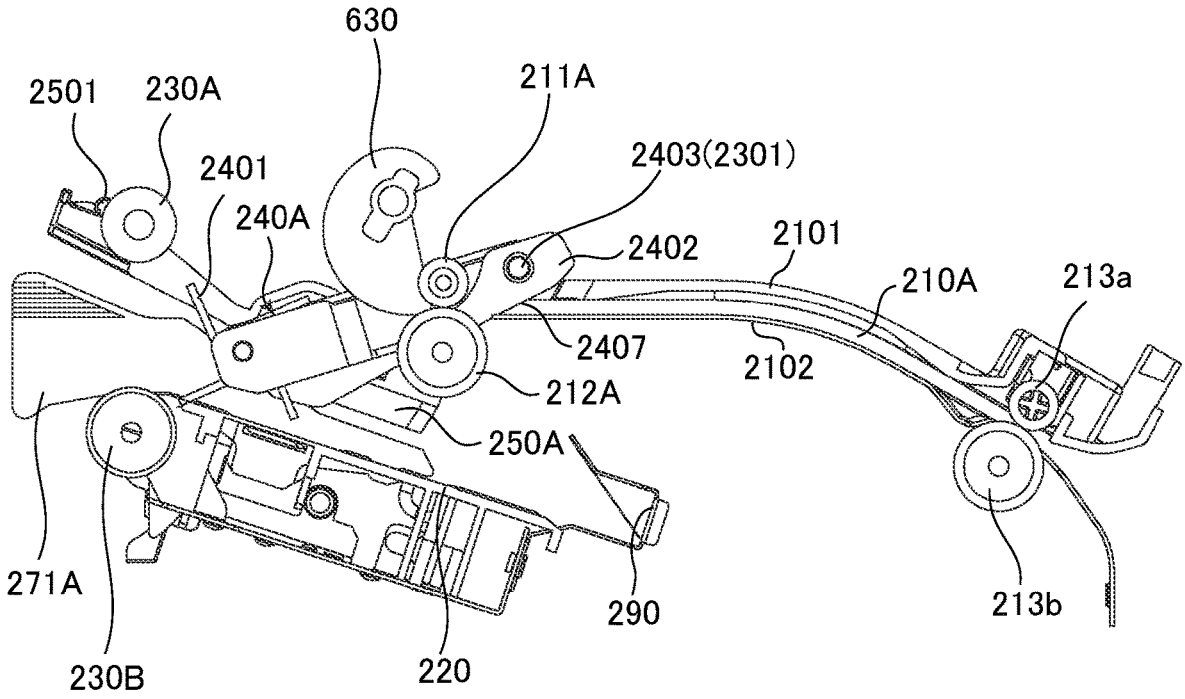
FIG. 22 is a cross-sectional view illustrating the state of the sheet processing apparatus according to the embodiment at the time of sheet reverse conveying, with the part of the apparatus omitted.
Figure 23:
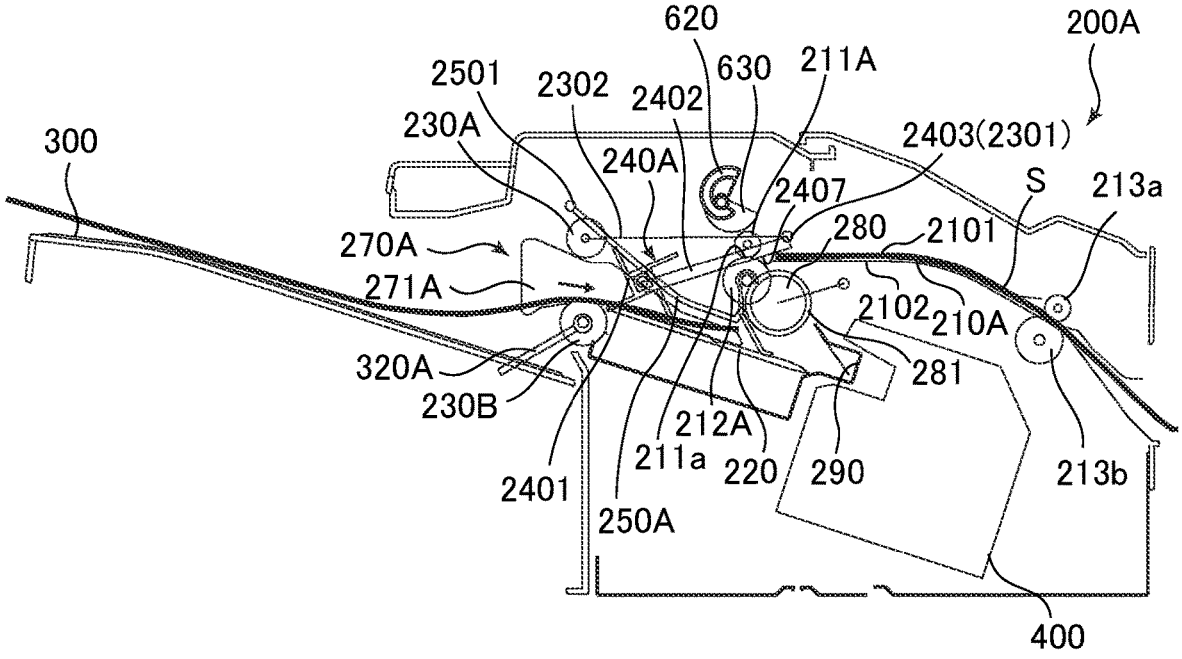
FIG. 23 is a schematic configuration cross-sectional view illustrating a state in which a leading edge of a succeeding sheet is restricted by the reversing paddle in the sheet processing apparatus according to the embodiment.

FIGS. 21 and 22 illustrate a state in which the reversing paddle 240A and the trailing edge dropping member 250A are at the return position and the lower position, respectively. That is, the drawing illustrates a state at the time of sheet reverse conveying in which the trailing edge of the sheet conveyed from the pre-processing rollers 211A and 212A is dropped onto the processing tray 220 by the trailing edge dropping member 250A, and the sheet on the processing tray 220 is conveyed in the second conveyance direction by the reversing paddle 240A.

In this state, the upper discharge roller 230A remains at the retracting position, the reversing paddle 240A moves from the upper retracting position to the return position, and the trailing edge dropping member 250A moves from the upper position to the lower position. In addition, the paddle arm 2402 of the reversing paddle 240A enters the conveyance path of the sheet on the upstream side of the pre-processing nip portion 211*a* in the first conveyance direction, and the sheet conveyed from the conveyance path 210A abuts on the leading edge regulating portion 2407 of the paddle arm 2402 before reaching the pre-processing nip portion 211*a*.

As illustrated in FIG. 23, it is assumed that the succeeding sheet S is conveyed toward the pre-processing nip portion 211*a* in the conveyance path 210A in a state where the trailing edge dropping member 250A cannot return to the upper position for some reason while being located at the lower position. In this case, since the reversing paddle 240A is configured to interlock with the trailing edge dropping member 250A, the reversing paddle 240A is located at the return position in a state where the trailing edge dropping member 250A is located at the lower position. As described above, at the return position, the paddle arm 2402 enters the conveyance path of the sheet on the upstream side of the pre-processing nip portion 211*a* in the first conveyance direction, so that the leading edge of the succeeding sheet S is regulated by the leading edge regulating portion 2407 of the paddle arm 2402. Then, the succeeding sheet S is jammed on the upstream side of the pre-processing nip portion 211*a*.

As described above, it is difficult to remove the jammed sheet downstream of the pre-processing rollers 211A and 212A in the first conveyance direction. Therefore, by jamming the succeeding sheet S on the upstream side of the pre-processing nip portion 211*a* as described above, the sheet S can be easily removed (jam processing). The jam processing of the sheet S will be described below.

Another Example of Leading Edge Regulation of Sheet

In the above description, the paddle arm 2402 of the reversing paddle 240A regulates the leading edge of the sheet. However, in the present embodiment, as described above, the trailing edge dropping member 250A is provided with the protruding portion 2504, and the protruding portion 2504 also has a function of regulating the leading edge of the sheet. This point will be described with reference to FIGS. 11C and 15A to 15C.

First, as described above, in the present embodiment, the stiffening member 214 (see FIGS. 12A to 14) is disposed on both sides in the width direction of the pre-processing rollers 211A and 212A in order to impart stiffness to the sheet. The stiffening member 214 is at a position overlapping the trailing edge dropping member 250A in the width direction. Therefore, the trailing edge dropping member 250A is provided with a recess portion 2505 at the distal end portion so as not to interfere with the stiffening member 214 at the time of pivoting.

As described above, the trailing edge dropping member 250A also serves to guide the sheet on the processing tray 220. That is, the sheet is dropped onto the processing tray 220 by the trailing edge dropping member 250A and then conveyed in the second conveyance direction toward the trailing edge regulation member 290 by the reversing paddle 240A. At this time, the upper surface of the sheet is guided by the lower surface of the trailing edge dropping member 250A to smoothly move the sheet toward the knurled belt 281 and the trailing edge regulation member 290. At this time, there is a possibility that the end portion of the sheet enters the recess portion 2505 formed at the distal end portion of the trailing edge dropping member 250A. In the present embodiment, as described above, the respective surfaces of the recess portion 2505 are inclined surfaces 2505*a*, 2505*b*, and 2505*c* in order to prevent the sheet from being caught in the recess portion 2505 even if the end portion of the sheet enters the recess portion 2505.

As described above, the connecting portion 2504*c* is provided with the positioning portion 2503 that positions the trailing edge dropping member 250A at the lower position. That is, the positioning portion 2503 is provided at the upper end portion of the protruding portion 2504. As described above, when the trailing edge dropping member 250A pivots from the upper position to the lower position, the positioning portion 2503 engages with the upper guide 2101 of the conveyance path 210A to position the trailing edge dropping member 250A at the lower position.

The protruding portion 2504 is provided integrally with the trailing edge dropping member 250A, and operates together with the pivoting of the trailing edge dropping member 250A. Then, in a state where the trailing edge dropping member 250A is at the lower position, the side wall portions 2504*a* and 2504*b* of the protruding portion 2504 enter the conveyance path of the sheet on the upstream side of the pre-processing nip portion 211*a* in the first conveyance direction. As a result, the leading edge of the sheet conveyed in the conveyance path 210A toward the pre-processing nip portion 211*a* is regulated by the side walls 2504*a* and 2504*b* of the protruding portion 2504. That is, the protruding portion 2504 of the trailing edge dropping member 250A corresponds to a leading edge regulating portion that regulates the leading edge of the sheet conveyed toward the nip position on the upstream side in the first conveyance direction with respect to the nip position, and in a case where the leading edge regulating portion 2407 of the paddle arm 2402 is a first leading edge regulating portion, the protruding portion 2504 corresponds to a second leading edge regulating portion.

As described above, in the present embodiment, it is possible to regulate the leading edge of the sheet on the upstream side in the first conveyance direction with respect to the nip position by both the paddle arm 2402 of the reversing paddle 240A and the protruding portion 2504 of the trailing edge dropping member 250A. However, either one may be omitted. For example, the protruding portion 2504 of the trailing edge dropping member 250 A may be omitted, and the leading edge of the sheet may be regulated only by the paddle arm 2402. Further, for example, the shape of the reversing paddle may be changed so that the paddle arm does not enter the upstream side of the pre-processing nip portion 211*a* when the reversing paddle is at the return position, and the leading edge of the sheet may be regulated only by the protruding portion 2504 of the trailing edge dropping member 250A.

Jam Processing

Figure 24:
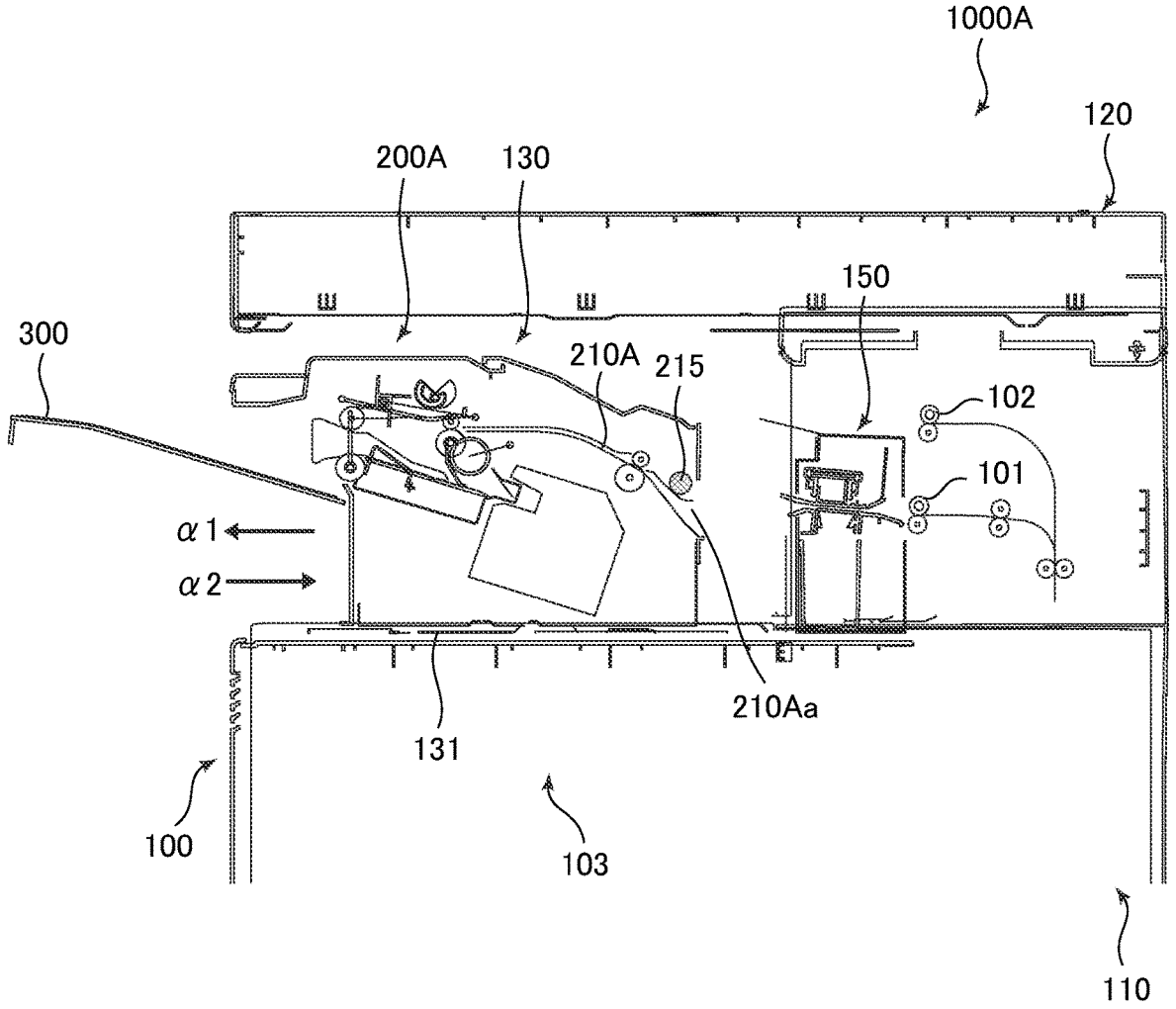
FIG. 24 is a schematic configuration cross-sectional view illustrating a state in which the sheet processing apparatus is separated from a discharge portion of an image forming apparatus body in the image forming system according to the embodiment.

Next, the jam processing of the sheet jammed on the upstream side of the pre-processing nip portion 211*a* by the paddle arm 2402 and the protruding portion 2504 will be described with reference to FIGS. 24 to 25B. In the present embodiment, in order to jam the sheet in the conveyance path 210A on the upstream side of the pre-processing nip portion 211*a* as described above, jam processing is performed in the conveyance path 210A. Specifically, as illustrated in FIG. 24, the sheet processing apparatus 200A is moved so as to be separated from the first discharge portion 101 of the image forming apparatus body 110. In the present embodiment, since the punch unit 150 is provided, the sheet processing apparatus 200A is moved in the direction of the arrow α1 so as to be separated from the punch unit 150. As a result, the operator can put his/her hand between the sheet processing apparatus 200A and the punch unit 150 to perform jam processing on the sheet jammed in the conveyance path 210A.

Figure 25A:
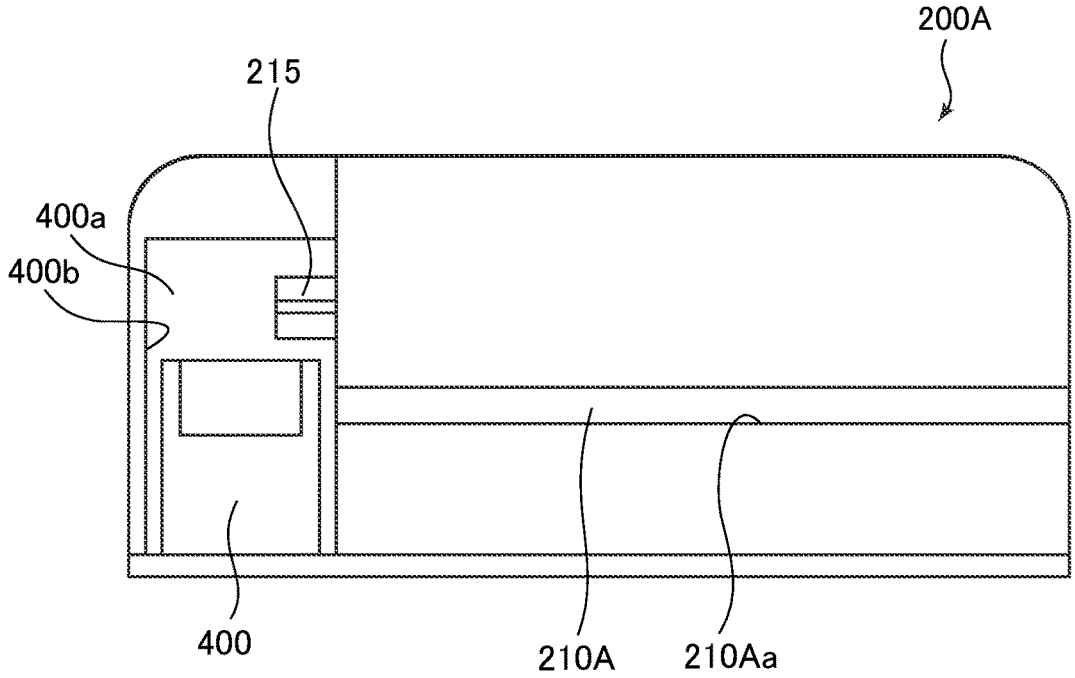
FIG. 25A is a schematic view of the sheet processing apparatus according to the embodiment as viewed from the upstream side in the first conveyance direction.
Figure 25B:
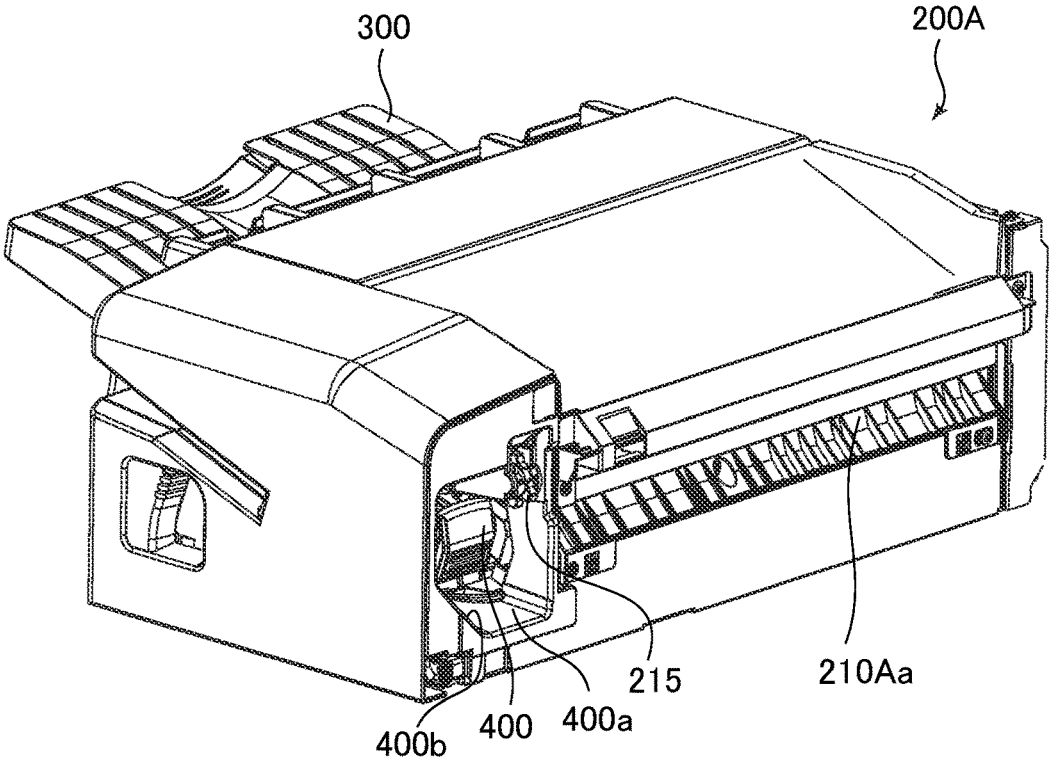
FIG. 25B is a perspective view of the sheet processing apparatus according to the embodiment as viewed from the upstream side in the first conveyance direction.

As illustrated in FIGS. 25A and 25B, an inlet 210Aa of the conveyance path 210A is formed on a surface of the sheet processing apparatus 200A on a side connected to the punch unit 150, that is, on an upstream surface in the first conveyance direction. An opening portion 400*b* of a space 400*a* in which the staple unit 400 is installed is formed adjacent to the inlet 210Aa on an upstream surface of the sheet processing apparatus 200A in the first conveyance direction. The space 400*a* is provided with a jam release dial 215 serving as a manual operation unit. Therefore, as illustrated in FIG. 24, in a state where the sheet processing apparatus 200A is separated from the punch unit 150, the inlet 210Aa and the opening portion 400*b* are exposed, and it is possible to remove sheets from the inlet 210Aa, replace the needle in the staple unit 400, and operate the jam release dial 215.

The jam release dial 215 is configured to manually drive one of the pre-processing rollers 211A and 212A serving as the first conveyance roller and one of the upstream rollers 213*a* and 213*b* serving as the second conveyance roller. That is, by rotating the jam release dial 215, the pre-processing roller and the upstream roller rotate in conjunction with each other. In the present embodiment, since the sheet is jammed on the upstream side of the pre-processing nip portion 211*a* as described above, the roller rotated by the jam release dial 215 may be at least an upstream roller of the pre-processing roller and the upstream roller.

As described above, in the present embodiment, in the case of performing the jam processing of the jammed sheet on the upstream side of the pre-processing nip portion 211*a*, first, the sheet processing apparatus 200A is separated from the punch unit 150 to expose the inlet 210Aa and the opening portion 400*b*. Then, by rotating the jam release dial 215, the pre-processing roller and the upstream roller are rotated, and the jammed sheet is manually conveyed to the inlet 210Aa. Then, the sheet conveyed to the inlet 210Aa is removed.

In the above description, the leading edge of the sheet is regulated on the upstream side of the pre-processing nip portion 211*a* by the paddle arm 2402 and the protruding portion 2504, but the position to regulate the sheet only needs to be on the upstream side in the first conveyance direction with respect to the nip position on the most downstream side in the first conveyance direction in the nip area. That is, the leading edge of the sheet may be located in the pre-processing nip portion 211*a*. Then, by rotating the jam release dial 215, since the pre-processing roller is rotated together with the upstream roller, the jammed sheet is manually conveyed to the inlet 210Aa.

As described above, in the present embodiment, even when the trailing edge dropping member 250A cannot return from the lower position to the upper position, the sheet is restricted on the upstream side in the first conveyance direction with respect to the nip position on the most downstream side in the first conveyance direction in the nip area of the pre-processing rollers 211A and 212A. Therefore, when the trailing edge dropping member 250A is at the lower position, it is possible to prevent the sheet from being jammed downstream of the pre-processing rollers 211A and 212A in the first conveyance direction, which is a position where it is difficult to perform the sheet jam processing.

Further, the sheet jammed upstream of the nip position in the first conveyance direction on the most downstream side in the first conveyance direction in the nip area can be easily removed by operating the jam release dial 215 to convey the sheet to the inlet 210Aa of the conveyance path 210A. Therefore, according to the configuration of the present embodiment, sheet jam processing can be facilitated.

Other Embodiments

In the above-described embodiment, the sheet processing apparatus 200A is disposed in the in-body space 130 of the image forming apparatus 100, but the configuration of the sheet processing apparatus of the present invention may be, for example, a configuration to be attached to a side surface of the image forming apparatus. Also, the sheet processing apparatus may be controlled by a control unit included in the image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-117882, filed Jul. 25, 2022, and Japanese Patent Application No. 2022-117883, filed Jul. 25, 2022, which are hereby incorporated by reference herein in their entirety.

What is claimed is:

1. A sheet processing apparatus comprising:

a pair of conveyance rollers configured to convey a sheet in a conveyance direction;

a tray on which the sheet conveyed by the pair of conveyance rollers is placed;

a sheet dropping portion configured to drop a sheet onto the tray by moving between a receiving position where the sheet conveyed toward the tray by the pair of conveyance rollers is received and a dropping position where the sheet dropping portion is located below the receiving position in a vertical direction;

an abutment portion against which an upstream end in the conveyance direction of the sheet placed on the tray abuts;

a conveyance portion configured to convey the sheet on the tray toward the abutment portion in a state where the sheet dropping portion is located at the dropping position;

a guide portion configured to guide the sheet toward the abutment portion when the sheet conveyed by the conveyance portion comes into contact with the guide portion; and a stapler configured to bind a plurality of the sheets abutted against the abutment portion;

wherein the sheet dropping portion includes a guide surface configured to guide the sheet toward the guide portion when the sheet conveyed by the conveyance portion comes into contact with the guide surface of the sheet dropping portion located at the dropping position; and wherein the guide surface overlaps a part of the guide portion when viewed in a rotational axis direction of the pair of conveyance rollers.

2. The sheet processing apparatus according to claim 1, further comprising a pivoting mechanism configured to pivot the sheet dropping portion about a pivot axis between the receiving position and the dropping position, wherein the pivot axis is located downstream relative to the pair of conveyance rollers in the conveyance direction, and the sheet dropping portion extends from the pivot axis toward an upstream side in the conveyance direction.

3. The sheet processing apparatus according to claim 2, wherein the sheet dropping portion is disposed such that a pivot locus of the sheet dropping portion overlaps the most-downstream position of a nip area in the conveyance direction where a sheet is nipped by the pair of conveyance rollers when viewed in the rotational axis direction of the pair of conveyance rollers.

4. An image forming system comprising:

an image forming unit configured to form an image on a sheet;

a pair of conveyance rollers configured to convey the sheet in a conveyance direction;

a tray on which the sheet conveyed by the pair of conveyance rollers is placed;

a sheet dropping portion configured to drop a sheet onto the tray by moving between a receiving position where the sheet conveyed toward the tray by the pair of conveyance rollers is received and a dropping position where the sheet dropping portion is located below the receiving position in a vertical direction;

an abutment portion against which an upstream end in the conveyance direction of the sheet placed on the tray abuts;

a conveyance portion configured to convey the sheet on the tray toward the abutment portion in a state where the sheet dropping portion is located at the dropping position;

a guide portion configured to guide the sheet toward the abutment portion when the sheet conveyed by the conveyance portion comes into contact with the guide portion; and a stapler configured to bind a plurality of the sheets abutted against the abutment portion;

wherein the sheet dropping portion includes a guide surface configured to guide the sheet toward the guide portion when the sheet conveyed by the conveyance portion comes into contact with the guide surface of the sheet dropping portion located at the dropping position, and wherein the guide surface overlaps a part of the guide portion when viewed in a rotational axis direction of the pair of conveyance rollers.

* * * * *